US010364659B1

(12) United States Patent
Tolman et al.

(10) Patent No.: US 10,364,659 B1
(45) Date of Patent: Jul. 30, 2019

(54) METHODS AND DEVICES FOR RESTIMULATING A WELL COMPLETION

(71) Applicants: Randy C Tolman, Spring, TX (US); P. Matthew Spiecker, Manvel, TX (US); Steve Lonnes, Spring, TX (US)

(72) Inventors: Randy C Tolman, Spring, TX (US); P. Matthew Spiecker, Manvel, TX (US); Steve Lonnes, Spring, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 0 days.

(21) Appl. No.: 16/144,322

(22) Filed: Sep. 27, 2018

(51) Int. Cl.

| | |
|---|---|
| ***E21B 34/14*** | (2006.01) |
| ***E21B 43/26*** | (2006.01) |
| ***E21B 34/06*** | (2006.01) |
| ***E21B 43/16*** | (2006.01) |
| ***E21B 17/18*** | (2006.01) |
| ***E21B 29/00*** | (2006.01) |
| ***E21B 43/14*** | (2006.01) |
| ***E21B 33/12*** | (2006.01) |

(52) U.S. Cl.
CPC ..... *E21B 43/162* (2013.01); *E21B 17/18* (2013.01); *E21B 29/00* (2013.01); *E21B 33/1208* (2013.01); *E21B 34/063* (2013.01); *E21B 43/14* (2013.01); *E21B 43/26* (2013.01)

(58) Field of Classification Search
CPC ..... E21B 34/14; E21B 43/14; E21B 43/26; E21B 2034/007; E21B 43/25; E21B 34/10; E21B 33/124; E21B 34/12; E21B 33/122; E21B 34/063
See application file for complete search history.

(56) References Cited

U.S. PATENT DOCUMENTS

| | | | |
|---|---|---|---|
| 3,450,203 | A | 6/1969 | Patron et al. |
| 5,234,055 | A | 8/1993 | Cornette |
| 5,579,844 | A | 12/1996 | Rebardi et al. |
| 5,704,426 | A | 1/1998 | Rytlewski et al. |
| 5,829,520 | A | 11/1998 | Johnson |
| 6,155,494 | A | 12/2000 | Fabbri et al. |
| 6,543,538 | B2 | 4/2003 | Tolman et al. |
| 6,907,936 | B2 | 6/2005 | Fehr et al. |
| 6,957,701 | B2 | 10/2005 | Tolman et al. |
| 7,059,407 | B2 | 6/2006 | Tolman et al. |
| 7,168,494 | B2 | 1/2007 | Starr et al. |
| 7,353,879 | B2 | 4/2008 | Todd et al. |
| 7,477,160 | B2 | 1/2009 | Lemenager et al. |

(Continued)

*Primary Examiner* — Zakiya W Bates
(74) *Attorney, Agent, or Firm* — ExxonMobil Upstream Research Company—Law Department

(57) ABSTRACT

Wellbore tubulars including selective stimulation ports (SSPs) sealed with sealing devices and methods of operating the same are disclosed herein. The wellbore tubulars include a tubular body that defines a tubular conduit and a plurality of selective stimulation ports. Each selective stimulation port includes an SSP conduit and a sealing device seat. The wellbore tubulars further include a plurality of sealing devices. Each sealing device includes a primary sealing portion that is seated on a corresponding sealing device seat and forms a primary seal with the corresponding sealing device seat. Each sealing device also includes a secondary sealing portion that extends from the primary sealing portion and forms a secondary seal between the primary sealing portion and the corresponding sealing device seat. The methods include methods of stimulating a subterranean formation utilizing the wellbore tubulars.

21 Claims, 11 Drawing Sheets

(56) References Cited

U.S. PATENT DOCUMENTS

| | | | |
|---|---|---|---|
| 7,516,792 | B2 | 4/2009 | Lonnes et al. |
| 7,575,062 | B2 | 8/2009 | East, Jr. |
| 7,735,559 | B2 | 6/2010 | Malone |
| 7,798,236 | B2 | 9/2010 | McKeachnie et al. |
| 8,167,047 | B2 | 5/2012 | Themig et al. |
| 8,215,411 | B2 | 7/2012 | Flores et al. |
| 8,220,542 | B2 | 7/2012 | Whitsitt et al. |
| 8,237,585 | B2 | 8/2012 | Zimmerman |
| 8,267,177 | B1 | 9/2012 | Vogel et al. |
| 8,276,670 | B2 | 10/2012 | Patel |
| 8,330,617 | B2 | 12/2012 | Chen et al. |
| 8,347,982 | B2 | 1/2013 | Hannegan et al. |
| 8,496,055 | B2 | 7/2013 | Mootoo et al. |
| 2002/0007949 | A1 | 1/2002 | Tolman et al. |
| 2004/0084190 | A1 | 5/2004 | Hill et al. |
| 2006/0118301 | A1 | 6/2006 | East, Jr. et al. |
| 2008/0093073 | A1 | 4/2008 | Bustos et al. |
| 2009/0032255 | A1 | 2/2009 | Surjaatmadja et al. |
| 2009/0101334 | A1 | 4/2009 | Baser et al. |
| 2010/0084134 | A1 | 4/2010 | Tulissi et al. |
| 2011/0048743 | A1 | 3/2011 | Stafford et al. |
| 2011/0168403 | A1 | 7/2011 | Patel |
| 2012/0043079 | A1 | 2/2012 | Wassouf et al. |
| 2012/0085548 | A1 | 4/2012 | Fleckenstein et al. |
| 2012/0090687 | A1 | 4/2012 | Grigsby et al. |
| 2012/0111566 | A1 | 5/2012 | Sherman et al. |
| 2012/0199349 | A1 | 8/2012 | Themig et al. |
| 2012/0292053 | A1 | 11/2012 | Xu et al. |
| 2013/0008648 | A1 | 1/2013 | Lovorn et al. |
| 2013/0105159 | A1 | 5/2013 | Alvarez et al. |
| 2013/0199790 | A1 | 8/2013 | Themig et al. |
| 2013/0206425 | A1 | 8/2013 | Mazyar et al. |
| 2013/0248174 | A1 | 9/2013 | Dale et al. |
| 2017/0159418 | A1 | 6/2017 | Tolman et al. |
| 2017/0159419 | A1 | 6/2017 | Tolman et al. |
| 2017/0159420 | A1 | 6/2017 | Tolman et al. |
| 2018/0135394 | A1 | 5/2018 | Tolman |

METHODS AND DEVICES FOR RESTIMULATING A WELL COMPLETION

FIELD OF THE DISCLOSURE

The present disclosure relates generally to wellbore tubulars including selective stimulation ports sealed with sealing devices and methods of operating the same, and more particularly to wellbore tubulars and methods utilizing sealing devices with both primary and secondary sealing portions.

BACKGROUND OF THE DISCLOSURE

Hydrocarbon wells generally include a wellbore that extends from a surface region and/or that extends within a subterranean formation that includes a reservoir fluid, such as liquid and/or gaseous hydrocarbons. After a wellbore is drilled, it is either fully cased with a wellbore tubular or pipe, or partially cased leaving a portion of the wellbore open as an open hole completion. Cased wellbore completions require selectively opening productive intervals within the wellbore, along the wellbore path. This process is commonly known as a well completion or completing a well.

Cased-hole well completions typically include a perforation operation comprising creating or opening apertures within the tubular wall, typically followed by a formation stimulation operation. The stimulation creates flow paths from the perforation into the reservoir formation to enhance production of the reservoir fluid therefrom. Stimulation of the subterranean formation may be accomplished in a variety of ways and generally includes supplying a stimulant fluid to the subterranean formation through the perforations to create increase wellbore fluid flow paths within as much of the reservoir as feasible. As an example, the stimulation may include supplying an acid to the subterranean formation to acid-treat the subterranean formation and/or to dissolve at least a portion of the subterranean formation. As another example, the stimulation may include fracturing the subterranean formation, such as by supplying a fracturing fluid, which is pumped at a high pressure, to the subterranean formation to create fractures within the formation. The fracturing fluid may include particulate material, such as a proppant, which may at least partially fill or prop open the fractures that are generated during the fracturing, thereby facilitating a formation fluid flow within the created fractures after supply of the fracturing fluid has ceased. Horizontal wellbores are frequently stimulated with multiple separate, individually pumped stimulation treatments, to effectively stimulate or treat the full course of the wellbore within the producing formation.

A variety of systems, devices, and/or methods have been developed over the years to address a variety of challenges, limitations, or issues related to stimulation, with the objective of improving stimulation effectiveness, fracture reach, and reservoir contact within the subterranean formations, providing varying degrees of improvement. Limitations still exist and need for improvement remains, as well completion and simulation costs are a significant portion of the total cost for drilling and producing fluid from a formation.

One area needing improvement relates to the inability to effectively seal some perforations during a multi-stage stimulation operation. Ineffective sealing allows for misplaced portions of stimulation fluid and loss of hydraulic power and stimulation effectiveness. Several causes contribute to the leaking perforations, including perforations that may not be perfectly round or may have burrs, which may make it challenging to seal the perforations with traditional ball sealers, subsequent to stimulating a given region of the subterranean formation. As another example, the perforations often will erode into irregular or non-circular shapes due to flow of proppant slurry through a perforation during a stimulation treatment and/or due to long-term flow of reservoir fluid and formation sand therethrough. Ball sealers may seal effectively on some perforations, seal somewhat on some perforations, or may failing to seal at all on still other severely eroded perforations.

In addition to conventional perforations created by shaped charges that are subject to erosion, one attempt at a solution has been to use selective stimulation ports (SSP's) that include a pre-positioned device installed in the casing wall. The SSP includes an aperture therein that is initially in a closed state by virtue of a destructible disk or gate and that can be converted to an open state with removal of the destructible disk or gate. When time is appropriate during a well completion operation to open a particular SSP, a charge may be positioned within the wellbore adjacent the SSP and actuated to cause a controlled explosion that destructs the destructible disk, thereby opening the aperture. Port erosions problems can still exist in SSP's. Additionally, an SSP completion may result in a stimulated series of well completion zones that are inflexibly limited to only stimulating and producing those zones that are immediately adjacent to an SSP layout that was predesigned before the wellbore casing was run into the wellbore. After stimulation treatment and production logging analysis, it may be desired to either retreat a particular reservoir zone or create additional productive apertures within the casing in a particular zone These challenges may occur early in the life of the hydrocarbon well, such as during and/or after initial completion thereof, and/or later in the life of the hydrocarbon well, such as after a period of production of the reservoir fluid with the hydrocarbon well and/or during and/or after restimulation of the hydrocarbon well. Thus, need exists for improved sealing of wellbore perforations during multizone stimulation completions, including devices and to methods of operating the same.

SUMMARY OF THE DISCLOSURE

Wellbore tubulars including selective stimulation ports (SSPs) sealed with sealing devices and methods of operating the same are disclosed herein. The wellbore tubulars include a tubular body that defines a tubular conduit and a plurality of selective stimulation ports. Each selective stimulation port includes an SSP conduit, which extends between an internal surface of the tubular body and an external surface of the tubular body, and a sealing device seat, which is shaped to form a fluid seal with a sealing device. The wellbore tubulars further include a plurality of sealing devices. Each sealing device includes a primary sealing portion that is seated on a corresponding sealing device seat and forms a primary seal with the corresponding sealing device seat. Each sealing device also includes a secondary sealing portion that extends from the primary sealing portion and forms a secondary seal between the primary sealing portion and the corresponding sealing device seat to at least partially restrict fluid flow through a leakage pathway between the primary sealing portion and the corresponding sealing device seat.

The methods include methods of stimulating a subterranean formation utilizing the wellbore tubulars. The methods include pressurizing the tubular conduit with a stimulant fluid and retaining an isolation device of an SSP in a closed state during the pressurizing. The methods also include generating a shockwave within a wellbore fluid that extends within a region of the tubular conduit that is proximal the SSP such that a magnitude of the shockwave, as received by the SSP, is greater than a threshold shockwave intensity sufficient to transition the isolation device from the closed state to an open state. The methods further include transitioning the isolation device from the closed state to the open state responsive to receipt of the shockwave that has greater than the threshold shockwave intensity thereby permitting fluid communication, via the SSP conduit, between the tubular conduit and the subterranean formation. The methods also include flowing the stimulant fluid into the subterranean formation, via the SSP conduit, to stimulate the subterranean formation and subsequently flowing a sealing device into contact with the sealing device seat. The sealing device includes a primary sealing portion and a secondary sealing portion that extends from the primary sealing portion, and the methods further include at least partially restricting fluid flow through the SSP conduit with the primary sealing portion and at least partially restricting fluid flow through a leakage pathway between the primary sealing portion and the sealing device seat with the secondary sealing portion. The methods include repeating the previous steps for another portion of the subterranean formation, using another SSP including another sealing device on another sealing device seat. The methods further include removing the sealing device and the another device from their respective sealing device seats and producing hydrocarbons through the fluid conduit via the SSP and the another SSP. The methods include thereafter sealing each of the SSP's with yet another sealing device in order to recomplete the well. Also included in the methods is the step of perforating the tubular conduit intermediate the first portion of the subterranean formation and another portion of the subterranean formation with a perforating gun to create an intermediately positioned perforation in the tubular conduit. The methods further include flowing another stimulant fluid into the subterranean formation through the created intermediate perforation to stimulate a portion of the subterranean formation adjacent the intermediate perforation.

DETAILED DESCRIPTION AND BEST MODE OF THE DISCLOSURE

Figure 1:
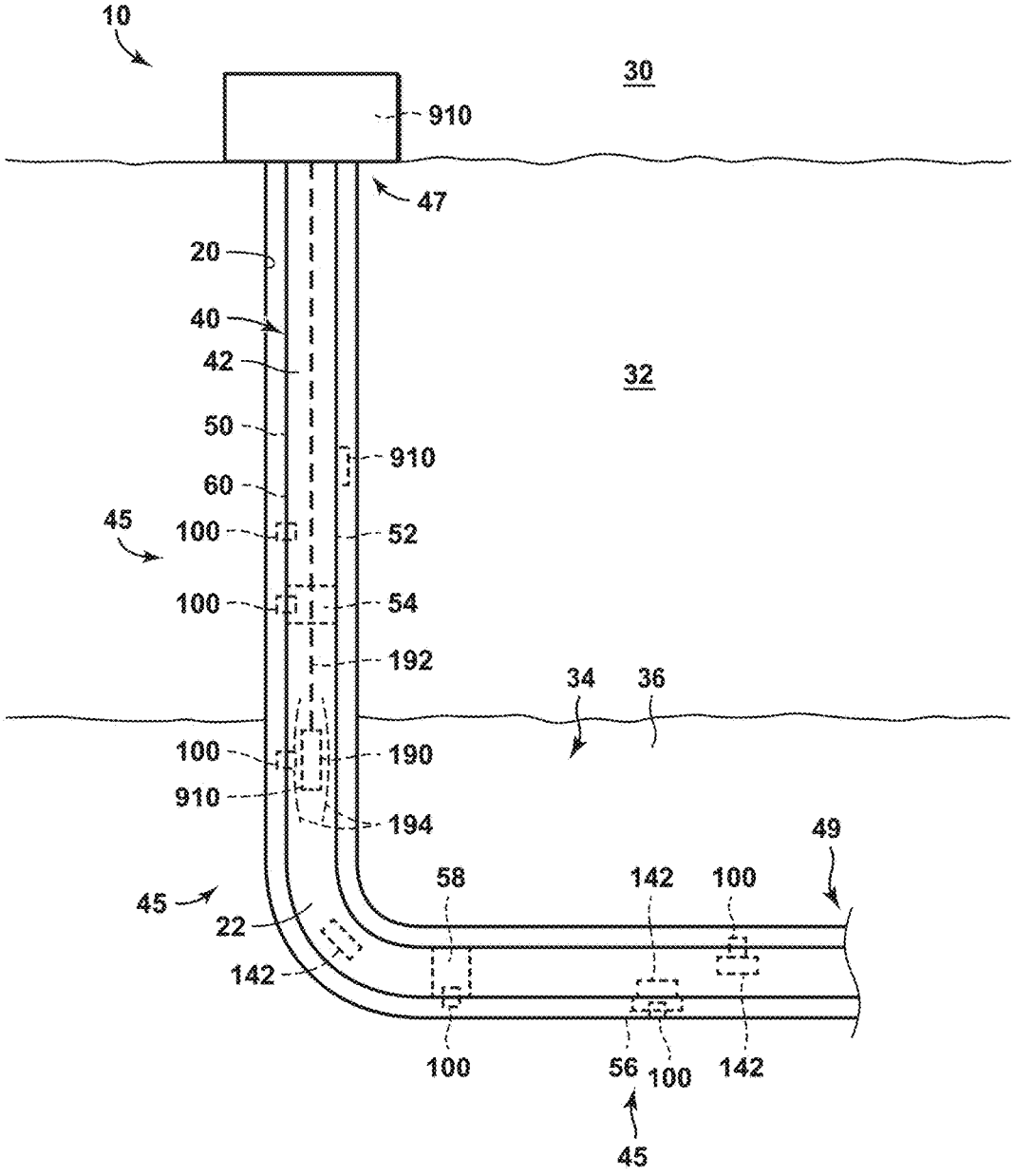
FIG. 1 is a schematic representation of examples of a hydrocarbon well that may include and/or utilize selective stimulation ports, wellbore tubulars, and/or methods according to the present disclosure.

FIGS. 1-17 provide examples of hydrocarbon wells 10, of wellbore tubulars 40, of selective stimulation ports 100, of sealing devices 940, and/or of methods 1000, according to the present disclosure. Elements that serve a similar, or at least substantially similar, purpose are labeled with like numbers in each of FIGS. 1-17, and these elements may not be discussed in detail herein with reference to each of FIGS. 1-17. Similarly, all elements may not be labeled in each of FIGS. 1-17, but reference numerals associated therewith may be utilized herein for consistency. Elements, components, and/or features that are discussed herein with reference to one or more of FIGS. 1-17 may be included in and/or utilized with any of FIGS. 1-17 without departing from the scope of the present disclosure. In general, elements that are likely to be included in a particular embodiment are illustrated in solid lines, while elements that are optional are illustrated in dashed lines. However, elements that are shown in solid lines may not be essential and, in some embodiments, may be omitted without departing from the scope of the present disclosure.

FIG. 1 is a schematic representation of examples of a hydrocarbon well 10 that may include and/or utilize selective stimulation ports 100 with associated sealing devices 142, wellbore tubulars 40, and/or methods 1000, according to the present disclosure. Hydrocarbon well 10 includes a wellbore 20 that extends from a surface region 30, within a subsurface region 32, within a subterranean formation 34 of a subsurface region 32, and/or between the surface region and the subterranean formation. Subterranean formation 34 includes a reservoir fluid 36, such as a liquid hydrocarbon and/or a gaseous hydrocarbon, and hydrocarbon well 10 may be utilized to produce, pump, and/or convey the reservoir fluid from the subterranean formation and/or to the surface region.

Hydrocarbon well 10 further includes wellbore tubular 40, which extends within wellbore 20 and defines a tubular conduit 42. Wellbore tubular 40 includes a plurality of selective stimulation ports (SSPs) 100, which are discussed in more detail herein. SSPs 100 are illustrated in dashed lines in FIG. 1 to indicate that the SSPs may be operatively attached to and/or may form a portion of any suitable component of wellbore tubular 40. In addition, one or more SSP 100 is associated with, is in mechanical contact with, and/or is sealed by a corresponding sealing device 142.

As discussed in more detail herein, a given sealing device 142 may be flowed, via tubular conduit 42, into contact with a given SSP 100. Thus, and as illustrated in FIG. 1, hydrocarbon well 10 and/or tubular conduit 42 thereof may include both sealing devices 142 that are seated upon and/or in contact with corresponding SSPs 100, and sealing devices 142 that are present within the tubular conduit but not necessarily in contact with a corresponding SSP 100.

As also illustrated in FIG. 1 and discussed in more detail herein, hydrocarbon well 10 may include one or more sealing device compartments 910, which may contain and/or house a corresponding sealing device. Sealing device compartments 910 may be present within surface region 30, may be operatively attached to wellbore tubular 40, and/or may form a portion of a shockwave generation device 190, as illustrated. In addition, sealing device compartments 910 may be configured to selectively release one or more sealing devices 142 into tubular conduit 42.

Wellbore tubular 40 may include and/or be any suitable tubular that may be present, located, and/or extended within wellbore 20. As examples, wellbore tubular 40 may include and/or be a casing string 50 and/or inter-casing tubing 60, which may be configured to extend within the casing string. SSPs 100 may be configured to be operatively attached to wellbore tubular 40, such as to casing string 50 and/or inter-casing tubing 60, prior to the wellbore tubular being located, placed, and/or installed within wellbore 20.

When wellbore tubular 40 includes casing string 50, SSPs 100 may be operatively attached to any suitable portion of the casing string. As examples, and as illustrated, one or more SSPs 100 may be operatively attached to one or more of a casing segment 52 of the casing string, such as a sub, or pup, joint of the casing string, a casing collar 54 of the casing string, a blade centralizer 56 of the casing string, and/or a sleeve 58 that extends around an outer surface of the casing string.

SSPs 100 may be operatively attached to wellbore tubular 40 in any suitable manner. As examples, SSPs 100 may be operatively attached to wellbore tubular 40 via any suitable mechanism, examples of which include one or more of a threaded connection, a glued connection, a press-fit connection, a welded connection, and/or a brazed connection.

As illustrated in dashed lines in FIG. 1, hydrocarbon well 10 also may include and/or have associated therewith an optional shockwave generation device 190. Shockwave generation device 190 may be configured to generate a shockwave 194 within tubular conduit 42 and/or within a wellbore fluid 22 that extends within the tubular conduit.

Shockwave generation device 190 may include and/or be any suitable structure that may, or may be utilized to, generate the shockwave within tubular conduit 42. As an example, shockwave generation device 190 may be an umbilical-attached shockwave generation device 190 that may be operatively attached to, or may be positioned within tubular conduit 42 via, an umbilical 192, such as a wireline, a tether, tubing, and/or coiled tubing. As another example, shockwave generation device 190 may be an autonomous shockwave generation device that may be flowed into and/or within tubular conduit 42 without an attached umbilical. As yet another example, the shockwave generation device may form a portion of one or more SSPs 100 and may be referred to as a shockwave generation structure 180, as discussed in more detail herein with reference to FIG. 2. As additional examples, shockwave generation device 190 may include an explosive charge, such as a length of primer cord and/or a blast cap. Primer cord also may be referred to herein as detonation cord and/or detonating cord and may be configured to explode and/or detonate, thereby generating shockwave 194.

FIGS. 2-7 provide examples of SSPs 100 according to the present disclosure. FIGS. 2-7 may be more detailed illustrations of SSPs 100 of FIG. 1, and any of the structures, functions, and/or features that are discussed and/or illustrated herein with reference to any of FIGS. 2-7 may be included in and/or utilized with SSPs 100 of FIG. 1 without departing from the scope of the present disclosure. Similarly, any of the structures, functions, and/or features that are discussed and/or illustrated herein with reference to hydrocarbon wells 10 and/or wellbore tubulars 40 of FIG. 1 may be included in and/or utilized with SSPs 100 of FIGS. 2-7 without departing from the scope of the present disclosure.

As illustrated collectively by FIGS. 2-7, SSPs 100 may include an SSP body 110 including a conduit-facing region 112, which is configured to face toward tubular conduit 42 when SSP 100 is installed within wellbore tubular 40 and/or within a tubular body 62 thereof. SSPs 100 also may include a formation-facing region 114, which is configured to face toward subterranean formation 34 when the SSP is installed within the wellbore tubular and the wellbore tubular extends within the subterranean formation. SSP and/or SSP body 110 thereof includes and/or defines an SSP conduit 116, which extends between conduit-facing region 112 and formation-facing region 114. Additionally or alternatively, SSP conduit 116 may be referred to herein as extending between an external surface 41 of tubular body 62 and an internal surface 43 of the tubular body, and the inner surface of the tubular body may be referred to herein as defining tubular conduit 42. As discussed in more detail herein, SSP conduit 116 may selectively establish a fluid flow path between tubular conduit 42 and subterranean formation 34.

Figure 2:
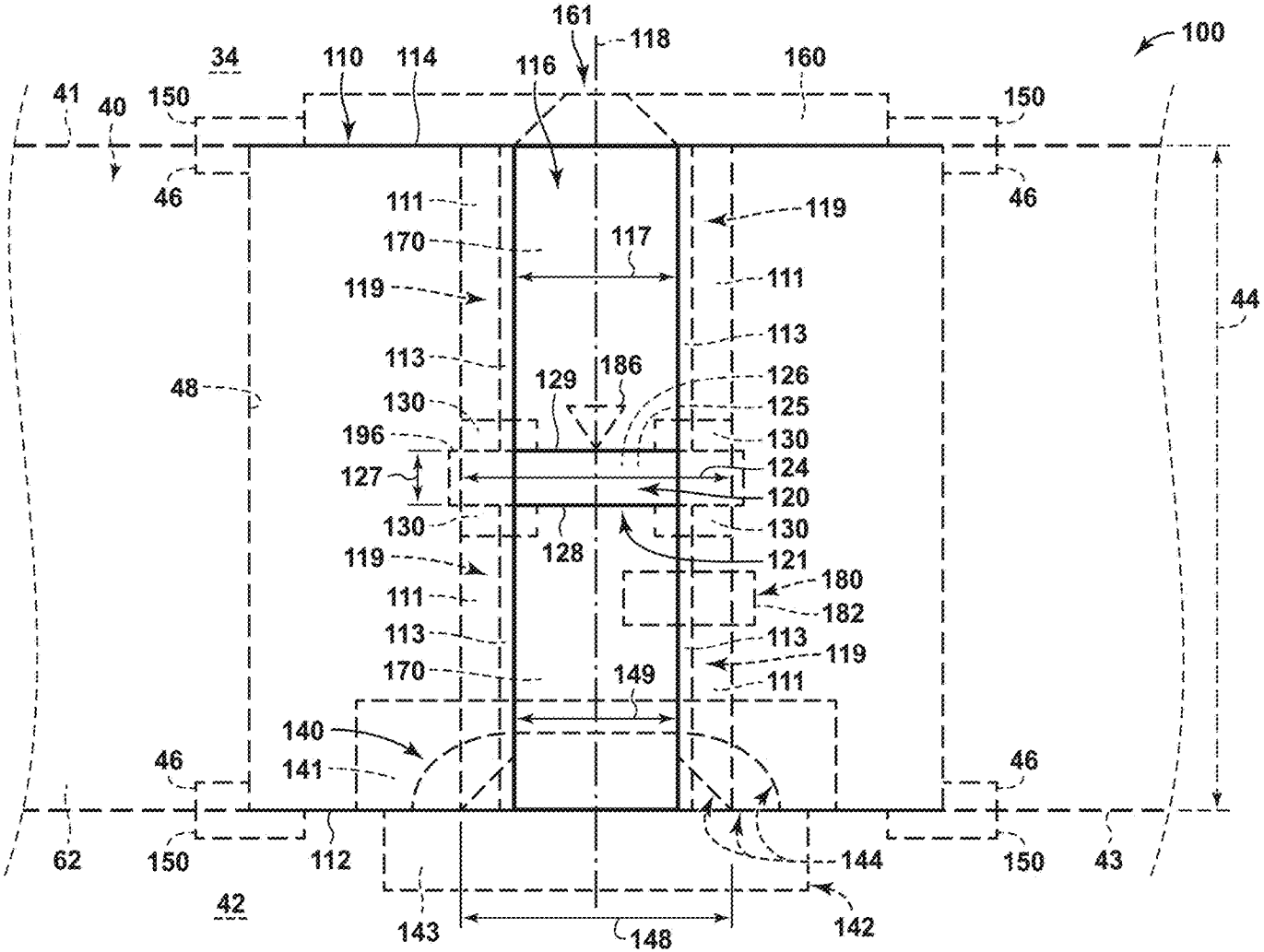
FIG. 2 is a schematic representation of selective stimulation ports according to the present disclosure.
Figure 3:
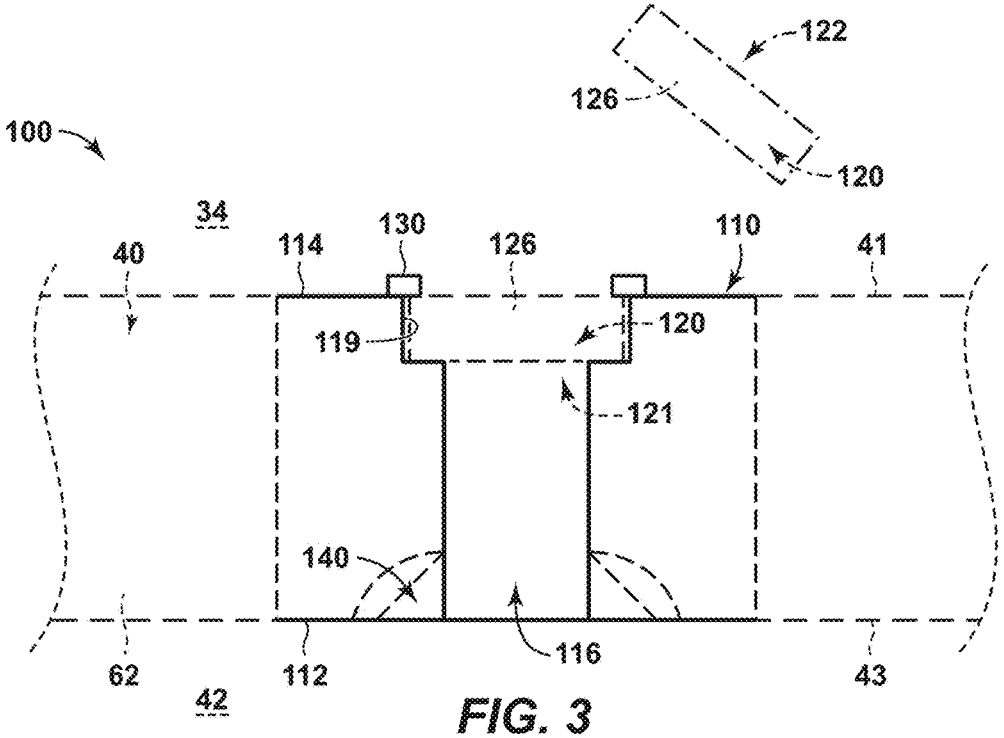
FIG. 3 is a less schematic cross-sectional view of selective stimulation ports according to the present disclosure.
Figure 4:
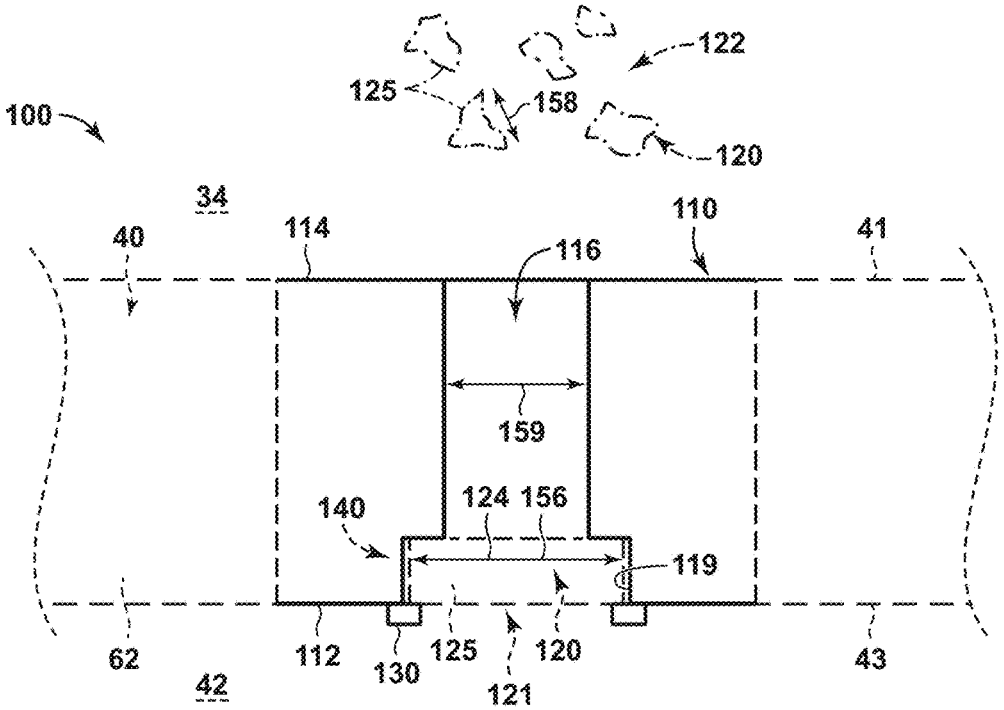
FIG. 4 is another less schematic cross-sectional view of selective stimulation ports according to the present disclosure.

SSP 100 also may include an isolation device 120. Isolation device 120 may extend within and/or across SSP conduit 116 and may be configured to selectively transition, or to be selectively transitioned, from a closed state 121, as illustrated in FIGS. 2-4 and 7, to an open state 122, as illustrated in FIGS. 3-4. When isolation device 120 is in closed state 121, the isolation device restricts, blocks, and/or occludes fluid flow within the SSP conduit, through the SSP conduit, and/or between tubular conduit 42 and subterranean formation 34 via the SSP conduit. Conversely, and when isolation device 120 is in open state 122, the isolation device permits, facilitates, does not restrict, does not block, and/or does not occlude the fluid flow within the SSP conduit, through the SSP conduit, and/or between tubular conduit 42 and subterranean formation 34 via the SSP conduit. Transitioning isolation device 120 from the closed state to the open state also may be referred to herein as transitioning SSP 100 from the closed state to the open state and/or as transitioning SSP conduit 116 from the closed state to the open state.

Isolation device 120 may be configured to transition from the closed state to the open state responsive to, or responsive to experiencing, a shockwave that has greater than a threshold shockwave intensity. A shockwave that has greater than the threshold shockwave intensity may be referred to herein as a threshold shockwave, a triggering shockwave, and/or a transitioning shockwave. The shockwave may be generated by a shockwave generation structure 180, which may be present within and/or may form a portion of SSP 100 and is illustrated in FIG. 2, and/or by a shockwave generation device 190, which may be separated and/or distinct from SSP 100 and is illustrated in FIG. 1. The shockwave may be generated within a wellbore fluid 22 and may be propagated from the shockwave generation device or the shockwave generation structure to the SSP via the wellbore fluid, as illustrated in FIG. 1. Examples of the wellbore fluid include reservoir fluid 36 and/or a stimulant fluid, as discussed in more detail herein.

SSP 100 further may include a retention device 130, as illustrated in FIGS. 2-4 and 7. Retention device 130 may be configured to couple, or operatively couple, isolation device 120 to SSP body 110, such as to retain the isolation device in the closed state prior to receipt of the threshold shockwave. Retention device 130 optionally may be configured to permit and/or facilitate transitioning of isolation device 120 from the closed state to the open state responsive to receipt of the threshold shockwave.

Figure 7:
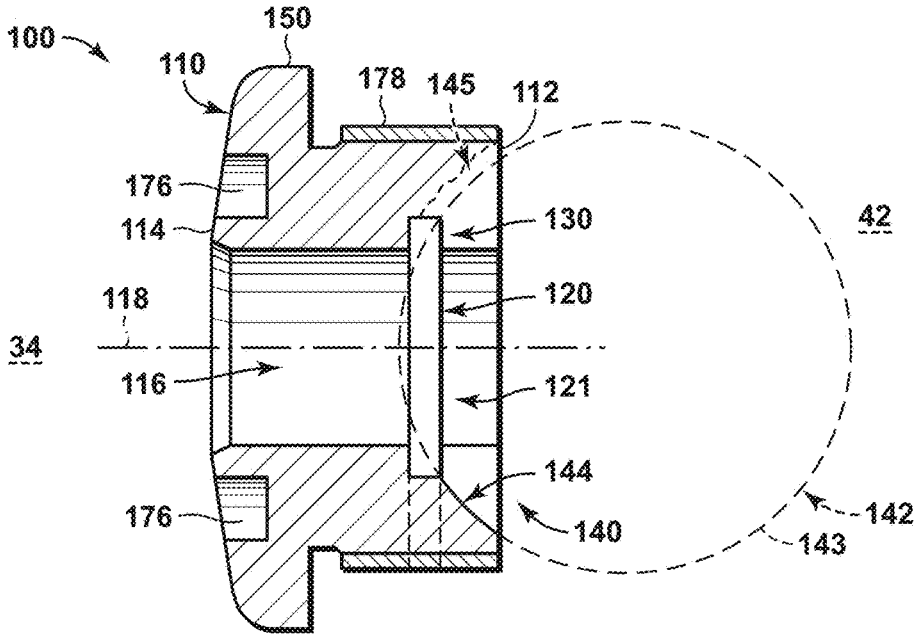
FIG. 7 is a cross-sectional view of the selective stimulation port of FIGS. 5-6 taken along line 7-7 of FIG. 6.

SSP 100 includes a sealing device seat 140, as illustrated in FIGS. 2-5 and 7. Sealing device seat 140 may be defined by conduit-facing region 112 of SSP body 110. In addition, sealing device seat 140 may be shaped to form a fluid seal 144 with a sealing device 142, as illustrated in FIGS. 2 and 7. The sealing device may be positioned on and/or in contact with the sealing device seat, such as to form the fluid seal, by flowing, via tubular conduit 42, into engagement with the sealing device seat. When the sealing device is engaged with the sealing device seat to form the fluid seal, the sealing device restricts, or selectively restricts, fluid flow from tubular conduit 42 to subterranean formation 34 via SSP conduit 116.

As discussed in more detail herein, wellbore tubulars 40 may have one or more SSPs 100 operatively attached thereto prior to the wellbore tubular being located, placed, and/or positioned within the wellbore. The SSPs may be in the closed state during operative attachment to the wellbore tubular and/or while the wellbore tubular is positioned within the wellbore. Subsequently, shockwave generation structure 180 of FIG. 2 and/or shockwave generation device 190 of FIG. 1 may be utilized to generate the shockwave within the wellbore fluid that extends within the tubular conduit and/or that extends in fluid communication with the isolation device. The shockwave may propagate within the wellbore fluid and/or to the SSP and may be received and/or experienced by at least a portion of the one or more SSPs.

However, the shockwave also is attenuated, is dampened, and/or decays as it propagates within the wellbore fluid. Thus, the shockwave will only have greater than the threshold shockwave intensity within a specific region of the wellbore tubular, and the one or more SSPs will only transition from the closed state to the open state if the one or more SSPs is located within this specific region of the wellbore tubular (i.e., if the shockwave has greater than the threshold shockwave intensity when the shockwave reaches, or contacts, the one or more SSPs). Thus, individual, selected, and/or specific SSPs 100 may be transitioned from the closed state to the open state without transitioning, or concurrently transitioning, other SSPs that are outside, or that are not within, the specific region of the wellbore tubular. Such a configuration may permit SSPs 100, according to the present disclosure, to be more selectively actuated, via the shockwave, when compared to more universally applied pressure spikes, which may act upon an entirety of a length of the wellbore tubular.

The shockwave may be attenuated, within the wellbore fluid, at any suitable (non-zero) shockwave attenuation rate. As examples, the shockwave attenuation rate may be at least 1 megapascal per meter (MPa/m), at least 2 MPa/m, at least 4 MPa/m, at least 6 MPa/m, at least 8 MPa/m, at least 10 MPa/m, at least 12 MPa/m, at least 14 MPa/m, at least 16 MPa/m, at least 18 MPa/m, or at least 20 MPa/m.

The shockwave also may have any suitable (non-zero) shockwave intensity, which also may be referred to herein as a peak shockwave pressure and/or as a maximum shockwave pressure. As examples, the shockwave intensity may be at least 100 megapascals (MPa), at least 110 MPa, at least 120 MPa, at least 130 MPa, at least 140 MPa, at least 150 MPa, at least 160 MPa, at least 170 MPa, at least 180 MPa, at least 190 MPa, at least 200 MPa, at least 250 MPa, at least 300 MPa, at least 400 MPa, or at least 500 MPa.

Similarly, the shockwave may have any suitable duration, which also may be referred to herein as a maximum duration, a shockwave duration, and/or a maximum shockwave duration. Examples of the maximum duration include durations of less than 1 second, less than 0.9 seconds, less than 0.8 seconds, less than 0.7 seconds, less than 0.6 seconds, less than 0.5 seconds, less than 0.4 seconds, less than 0.3 seconds, less than 0.2 seconds, less than 0.1 seconds, less than 0.05 seconds, or less than 0.01 seconds. The maximum duration may be a maximum period of time during which the shockwave has greater than the threshold shockwave intensity within the wellbore tubular. Additionally or alternatively, the maximum duration may be a maximum period of time during which the shockwave has a shockwave intensity of greater than 68.9 MPa (10,000 pounds per square inch) within the wellbore tubular.

With the above in mind, the shockwave may exhibit greater than the threshold shockwave intensity over only a fraction of a length of the wellbore tubular and only for a brief period of time. As examples, the shockwave may exhibit greater than the threshold shockwave intensity over a maximum effective distance of 1 meter, 2 meters, 3 meters, 4 meters, 5 meters, 6 meters, 7 meters, 8 meters, 10 meters, 15 meters, 20 meters, or 30 meters along a length of the tubular conduit. Stated another way, the shockwave may have a peak shockwave intensity proximate an origination point thereof (i.e., proximate the shockwave generation device, the shockwave generation structure, and/or a shockwave generation source thereof). The threshold shockwave intensity may be less than, or less than a threshold fraction of, the peak shockwave intensity, and an intensity of the shockwave may be less than the threshold shockwave intensity at distances that are greater than the maximum effective distance from the origination point.

The shockwave generation structure and/or the shockwave generation device may be configured such that the shockwave emanates symmetrically, or at least substantially symmetrically, therefrom. Stated another way, the shockwave generation structure and/or the shockwave generation device may be configured such that the shockwave emanates isotropically, or at least substantially isotropically, therefrom. Stated yet another way, the shockwave generation structure and/or the shockwave generation device may be configured such that the shockwave is symmetric, or at least substantially symmetric, within a given transverse cross-section of the wellbore tubular.

SSP 100 and/or SSP body 110 thereof may include any suitable structure that may have, include, and/or define conduit-facing region 112, formation-facing region 114, and/or SSP conduit 116. In addition, SSP 100 and/or SSP body 110 thereof may be formed from any suitable material, and the SSP body may be formed from a different material than a material of wellbore tubular 40, than a material of a majority of wellbore tubular 40, and/or than a material that comprises a portion of wellbore tubular 40 that is operatively attached to SSP 100 and/or to SSP body 110 thereof.

It is within the scope of the present disclosure that SSP 100 and/or SSP body 110 thereof may be a single-piece, or monolithic. Alternatively, it also is within the scope of the present disclosure that SSP 100 and/or SSP body 110 thereof may be a composite that may be formed from a plurality of distinct, separate, and/or chemically different components.

As illustrated in dashed lines in FIG. 2, SSP 100 and/or SSP body 110 thereof may be separate from, distinct from, and/or may be formed from a different material than wellbore tubular 40. Under these conditions, SSP body 110 may be configured to be operatively attached to the wellbore tubular with the SSP body extending through a tubular aperture 48 that may be defined within the wellbore tubular and/or that may extend between tubular conduit 42 and an external surface 41 of the wellbore tubular. In such a configuration, SSP 100 and/or SSP body 110 thereof may include a projecting region 150 that may be configured to project past tubular aperture 48. The projecting region may project transverse, or perpendicular to, a central axis 118 of SSP conduit 116. Stated another way, at least a portion of SSP 100 and/or SSP body 110 thereof may have a maximum outer diameter that is greater than an inner diameter of tubular aperture 48. In such a configuration, wellbore tubular 40 may define a recess 46 that may be configured to receive projecting region 150.

Additionally or alternatively, SSP 100 and/or SSP body 110 thereof also may be at least partially defined by wellbore tubular 40 and/or by any suitable component thereof. As examples, SSP 100 and/or SSP body 110 thereof may be partially, or even completely, defined by casing string 50, casing segment 52, casing collar 54, blade centralizer 56, sleeve 58, and/or inter-casing tubing 60 of FIG. 1.

As illustrated in FIG. 2, SSP 100 and/or SSP body 110 thereof may be configured such that the SSP does not extend into tubular conduit 42 and/or such that the SSP does not extend, or project, past internal surface 43 of wellbore tubular 40 that defines tubular conduit 42. Stated another way, conduit-facing region 112 and/or sealing device seat 140 of SSP 100 may be flush with internal surface 43 and/or may be recessed within tubular aperture 48, when present. Thus, SSP 100 may not block and/or restrict fluid flow within tubular conduit 42 and/or the presence of SSP 100 may not change a transverse cross-sectional area for fluid flow within tubular conduit 42.

Stated yet another way, a transverse cross-sectional area of a portion of the tubular conduit that includes one or more SSPs may be at least a threshold fraction of a transverse cross-sectional area of a portion of the tubular conduit that does not include an SSP, or any SSPs. Examples of the threshold fraction of the transverse cross-sectional area include threshold fractions of at least 80 percent, at least 85 percent, at least 90 percent, at least 92.5 percent, at least 95 percent, at least 96 percent, at least 97 percent, at least 98 percent, or at least 99 percent of the transverse cross-sectional area.

As discussed in more detail herein, conventional stimulation methods may utilize a shape-charge perforation device to create, generate, and/or define one or more perforations within a casing string that extends within a subterranean formation. As also discussed, such perforations may not be symmetrical, may not be round, and/or may not form a fluid-tight seal with sealing device 142. In addition, and as also discussed, stimulation of the subterranean formation may include flowing a stimulant fluid that may include particulate material through the perforations, which may be abrasive to the perforations, and/or flowing a stimulant fluid that may include a corrosive material through the perforations, which may corrode the perforations. Additionally or alternatively, long-term flow of the reservoir fluid through the perforations also may corrode the perforations. Thus, flow of the stimulant fluid through the perforations further may change the shape of the perforations. This change in shape further may decrease an ability for the perforations to form a fluid-tight seal with the sealing device and/or may cause an increase in a cross-sectional area for fluid flow through the perforations, thereby increasing a flow rate of the stimulant fluid through the perforations for a given pressure drop thereacross. Either situation may be detrimental to, may decrease a reliability of, and/or may increase a complexity of stimulation operations that utilize perforations created by shape-charge perforation devices.

With this in mind, SSPs 100 according to the present disclosure may be at least partially erosion-resistant and/or corrosion-resistant, or at least more erosion-resistant and/or corrosion-resistant than wellbore tubular 40. As an example, SSP body 110 may include and/or be an erosion-resistant SSP body that may be configured to resist erosion by the particulate material. As a more specific example, the SSP body may include an erosion-resistant material that is more resistant to erosion than a material forming a portion of the wellbore tubular to which the SSP is attached. The erosion-resistant material may form at least a portion of any suitable region and/or component of SSP body 110. As examples, the erosion-resistant material may form at least a portion of conduit-facing region 112, formation-facing region 114, sealing device seat 140, and/or an internal portion of SSP body 110 that defines SSP conduit 116.

It is within the scope of the present disclosure that the erosion-resistant material may form and/or define the entire, or an entirety of, SSP body 110. Alternatively, it also is within the scope of the present disclosure that the erosion-resistant material may form only a portion, a subset, or less than an entirety of the SSP body and/or that the erosion-resistant material may be different from a material of a remainder of the SSP body. As an example, the erosion-resistant material may include and/or be an erosion-resistant sleeve 111 that is operatively attached to the SSP body and/or an erosion-resistant coating 113 that covers at least a portion of the SSP body, as illustrated in FIG. 2. As another example, the erosion-resistant material may include and/or be an erosion-resistant layer, coating, and/or ring that is operatively attached to and/or forms all or a portion of sealing device seat 140.

SSP 100 and/or SSP body 110 thereof additionally or alternatively may include and/or be a corrosion-resistant SSP and/or a corrosion-resistant SSP body that may be configured to resist corrosion by, within, or while in contact with, the stimulant fluid, such as a stimulant fluid that includes, or is, an acid. As a more specific example, the SSP body may include a corrosion-resistant material that is more resistant to corrosion than a material forming a portion of the wellbore tubular to which the SSP is attached. The corrosion-resistant material may form at least a portion of any suitable region and/or component of SSP body 110. As examples, the corrosion-resistant material may form at least a portion of conduit-facing region 112, formation-facing region 114, sealing device seat 140, and/or an internal portion of SSP body 110 that defines SSP conduit 116.

It is within the scope of the present disclosure that the corrosion-resistant material may form and/or define the entire, or an entirety of, the SSP body. Alternatively, it is also within the scope of the present disclosure that the corrosion-resistant material may form only a portion, a subset, or less than an entirety of the SSP body and/or that the corrosion-resistant material may be different from a material of a remainder of the SSP body. As an example, the corrosion-resistant material may include and/or be a corrosion-resistant sleeve 111 that is operatively attached to the SSP body and/or a corrosion-resistant coating 113 that covers at to least a portion of the SSP body. As another example, the corrosion-resistant material may include and/or be a corrosion-resistant layer, coating, and/or ring that is operatively attached to and/or forms all or a portion of sealing device seat 140.

Examples of the erosion-resistant material, of the corrosion-resistant material, and/or of other materials that may be included within SSP body 110 include one or more of a nitride, a nitride coating, a boride, a boride coating, a carbide, a carbide coating, a tungsten carbide, a tungsten carbide coating, a self-hardening alloy, a work-hardening alloy, high manganese work-hardening steel, a ceramic, a high strength steel, a diamond-like material, a diamond-like coating, a heat-treated material, a magnetic material, and/or a radioactive material. When SSP body 110 includes and/or is formed from the magnetic material and/or the radioactive material, shockwave generation device 190 of FIG. 1 may be configured to detect and/or determine a proximity between SSP 100 and the shockwave generation device by detecting the presence of, or proximity to, the magnetic material and/or the radioactive material.

Whether or not SSP 100 and/or SSP body 110 thereof includes and/or is formed from the erosion-resistant material and/or the corrosion-resistant material, the SSP and/or the SSP body still may erode and/or corrode, at least to some extent, during utilization thereof. Stated another way, SSP 100 and/or SSP body 110 thereof may erode and/or corrode to a lesser extent when compared to a perforation that might be formed within wellbore tubular 40; however, erosion and/or corrosion of the SSP and/or of the SSP body still may be finite, detectable, and/or significant enough to impact, or decrease a reliability of, sealing between sealing device seat 140 and a sealing device. As such, and as discussed in more detail herein with reference to FIGS. 8-11 and 16, SSPs 100 disclosed herein may be utilized with a sealing device 142, in the form of a sealing assembly 920, that includes both a primary sealing portion 950 and a secondary sealing portion 970.

SSP conduit 116 may include and/or be any suitable fluid conduit that extends between the conduit-facing region and the formation-facing region and/or that may be configured to convey a fluid between the tubular conduit and the subterranean formation when isolation device 120 is in the open state. In addition, SSP conduit 116 may have any suitable inner diameter, cross-sectional area, and/or transverse cross-sectional area. As an example, SSP conduit 116 may include and/or be a cylindrical, or at least substantially cylindrical, SSP conduit. The cylindrical SSP conduit may have a diameter of at least 0.1 centimeter (cm), at least 0.15 cm, at least 0.2 cm, at least 0.25 cm, at least 0.5 cm, at least 0.75 cm, at least 1 cm, at least 1.5 cm, at least 2 cm, at least 2.5 cm, at least 3 cm, or at least 3.5 cm. Additionally or alternatively, the cylindrical SSP conduit may have a diameter of less than 6 cm, less than 5.5 cm, less than 5 cm, less than 4.5 cm, less than 4 cm, less than 3.5 cm, less than 3 cm, or less than 2.5 cm.

Additionally or alternatively, the SSP conduit may have a diameter that is less than an average tubular conduit diameter of tubular conduit 42. As examples, the SSP conduit may have a diameter that is less than 20 percent, less than 15 percent, less than 10 percent, or less than 5 percent of the average tubular conduit diameter of tubular conduit 42.

When SSP conduit 116 is not the cylindrical SSP conduit, a transverse cross-sectional area of the SSP conduit may be comparable, or equal, to the cross-sectional areas of cylindrical SSP conduits that have any of the above-listed diameters and/or diameter ranges. In addition, and when SSP conduits 116 of the plurality of SSPs 100 have different and/or varying diameters, the plurality of SSPs may define an average SSP conduit diameter, and the average SSP conduit diameter may include any of the above-listed diameters.

As illustrated in FIG. 1, SSPs 100 may be spaced-apart, or longitudinally spaced-apart, along a longitudinal length of wellbore tubular 40. Wellbore tubular 40 may be referred to herein as having an uphole tubular end, or region, 47 and a downhole tubular end, or region 49. In addition, each SSP 100 may have and/or define a minimum SSP conduit cross-sectional, or transverse cross-sectional, area.

Under these conditions, the minimum SSP conduit cross-sectional area may vary systematically along the longitudinal length of the wellbore tubular. As an example, the minimum SSP conduit cross-sectional area may increase systematically from the uphole tubular end and toward the downhole tubular end. Such a configuration may be utilized to provide a desired resistance to fluid flow between each SSP conduit and uphole end 47 of the wellbore tubular.

Additionally or alternatively, and with continued reference to FIG. 1, wellbore tubular 40 may include a plurality of stimulation zones, or regions, 45 including an uphole zone end and a downhole zone end. Under these conditions, each stimulation zone may include a respective subset of the plurality of SSPs, and the minimum SSP conduit cross-sectional area of the respective SSPs within a given stimulation zone may increase systematically from the uphole zone end toward the downhole zone end.

Alternatively, the minimum SSP conduit cross-sectional area may be constant, or at least substantially constant, within a given region of the wellbore tubular. As an example, the minimum SSP conduit cross-sectional area may be constant within a given stimulation zone 45. As another example, the minimum SSP conduit cross-sectional area may be constant along an entirety of the longitudinal length of the wellbore tubular.

Isolation device 120 may include and/or be any suitable structure that may extend within SSP conduit 116, that may selectively restrict fluid flow through the SSP conduit, and/or that may be configured to selectively transition from the closed state to the open state responsive to the threshold shockwave. In general, isolation device 120 may be adapted, configured, designed, and/or constructed only to exhibit a single, or irreversible, transition from the closed state to the open state. As examples, and as discussed in more detail herein, isolation device 120 may be configured to break apart, to be destroyed, to be displaced from, and/or to irreversibly separate from a remainder of SSP 100 and/or from SSP body 110 upon transitioning from the closed state to the open state.

Isolation device 120 may include and/or be formed from any suitable material. As examples, the isolation device may include and/or be formed from a magnetic material and/or a radioactive material and/or acid soluble material. Additional examples of materials of isolation device 120 are disclosed herein. When isolation device 120 includes and/or is formed from the magnetic material and/or the radioactive material, these materials may be detected by shockwave generation device 190, as discussed herein.

As discussed, isolation device 120 may be configured to transition from the closed state to the open state responsive to the threshold shockwave, and examples of the threshold shockwave and the threshold shockwave intensity are disclosed herein. Isolation device 120 also may be configured to remain in the closed state, or to resist transitioning from the closed state to the open state, during, or despite, a static pressure differential thereacross. This static pressure differential may have a significant magnitude, and examples of the static pressure differential, which also may be referred to herein as a threshold static pressure differential, include pressure differentials of at least 40 MPa, at least 45 MPa, at least 50 MPa, at least 55 MPa, at least 60 MPa, at least 65 MPa, at least 68 MPa, at least 68.9 MPa, at least 70 MPa, at least 75 MPa, at least 80 MPa, at least 85 MPa, at least 90 MPa, at least 95 MPa, or at least 100 MPa.

Isolation device 120 may be positioned, located, and/or present at any suitable location within SSP 100 and/or within SSP conduit 116 thereof. As an example, and as illustrated in FIG. 2, isolation device 120 may be positioned within a central portion of SSP conduit 116, proximal a midpoint of a length of SSP conduit 116, and/or such that the isolation device is offset from conduit-facing region 112 and also from formation-facing region 114. As another example, and as illustrated in FIG. 3, isolation device 110 may be aligned with and/or proximal formation-facing region 114. As yet another example, and as illustrated in FIG. 4, isolation device 120 may be aligned with and/or proximal conduit-facing region 112. Under these conditions, isolation device 120 may protect sealing device seat 140 from abrasion and/or corrosion while in closed state 121.

Isolation device 120 also may have any suitable isolation device thickness 127, as illustrated in FIG. 2. As an example, isolation device thickness 127 may be less than a wellbore tubular thickness 44 of wellbore tubular 40. Both isolation device thickness 127 and wellbore tubular thickness 44 may be measured in a direction that is parallel to central axis 118 of SSP conduit 116.

As illustrated in FIGS. 2-4, SSP body 110 may include and/or define an isolation device recess 119, which may be configured to receive isolation device 120. Isolation device recess 119 may extend from conduit-facing region 112 of SSP body 110, as illustrated schematically in FIG. 2 and less schematically in FIG. 4. Additionally or alternatively, isolation device recess 119 also may extend from formation-facing region 114 of SSP body 110, as illustrated schematically in FIG. 2 and less schematically in FIG. 3. When SSP body 110 includes isolation device recess 119, retention device 130 may be configured to at least temporarily retain the isolation device within the isolation device recess, as also illustrated in FIGS. 2-4.

Isolation device 120 also may have and/or define any suitable shape. As an example, a shape of an outer perimeter of isolation device 120 may be complementary to, or may correspond to, a transverse cross-sectional shape of isolation device recess 119, when present, and/or to a transverse cross-sectional shape of SSP conduit 116. As another example, and as illustrated in FIG. 2, isolation device 120 may include a conduit-facing side 128 and a formation-facing side 129, and the conduit-facing side and/or the formation-facing side may be planar, at least substantially planar, arcuate, partially spherical, partially parabolic, partially cylindrical, and/or partially hyperbolic. Stated another way, isolation device 120 may have a non-constant thickness as measured in a direction that extends between conduit-facing region 112 and formation-facing region 114 of SSP body 110 and/or as measured in a direction that is parallel to central axis 118.

In general, the shape of the isolation device may be selected such that the isolation device is shaped to resist at least a threshold static pressure differential between conduit-facing side 128 and formation-facing side 129 without damage thereto. Examples of the threshold static pressure differential are disclosed herein.

An example of isolation device 120 is an isolation disk 126, as illustrated in FIGS. 2-3. As illustrated in dashed lines in FIG. 3, isolation disk 126 may be configured to be retained within SSP 100 by retention device 130 when the isolation device is in closed state 121. However, and as illustrated in dash-dot lines, isolation disk 120 may be configured separate from a remainder of SSP 100 and/or to be displaced or otherwise conveyed into subterranean formation 34 in an intact, or at least substantially intact, state when the isolation device transitions to open state 122. This may include the isolation disk being conveyed from formation-facing region 114 of SSP body 110 and/or being conveyed from a formation-facing end of SSP conduit 116, with the formation-facing end of the SSP conduit being defined by formation-facing region 114. Isolation disk 126 may include any suitable material and/or materials of construction, examples of which include a metallic isolation disk that may be formed from one or more of steel, stainless steel, cast iron, a metal alloy, brass, and/or copper. When SSPs 100 include isolation disk 126 of FIGS. 2-3, and as discussed in more detail herein, retention device 130 may be configured to selectively release the isolation disk from the SSP responsive to the threshold shockwave.

Another example of isolation device 120 is a frangible isolation device 120 that is formed from a frangible material. The frangible material may be configured to break apart, to be destroyed, and/or to disintegrate responsive to, responsive to experiencing, and/or responsive to receipt of the threshold shockwave. Such an isolation device also may be referred to herein as a frangible disk 125 and/or as a frangible isolation disk 125 and is illustrated in FIGS. 2 and 4. Examples of the frangible material include a glass, a tempered glass, a ceramic, a frangible magnetic material, a frangible radioactive material, a frangible ceramic magnet, a frangible alloy, and/or an acrylic.

Additionally or alternatively, isolation device 120 may include and/or be formed from an explosive material that is configured to detonate and/or explode responsive to, responsive to experiencing, and/or responsive to receipt of the threshold shockwave. An isolation device 120 with this explosive material may be referred to as an explosive isolation device 120. Examples of explosive material that may be utilized include a solid explosive material, a brittle explosive material, a frangible explosive material, and/or a solid rocket fuel. The explosive material also may be referred to herein as an accelerant that accelerates stimulation of the subterranean formation due to the resulting explosion and generation of gases that promote greater fracturing initiation and/or stimulation of the subterranean formation.

As discussed, frangible isolation devices 120, such as frangible disks 125, may be configured to break apart responsive to receipt of the threshold shockwave. As an example, and as illustrated in FIG. 4, such isolation devices may comprise a single piece prior to receipt of the threshold shockwave (as illustrated in dashed lines) and may comprise a plurality of spaced-apart pieces subsequent to receipt of the threshold shockwave (as illustrated in dash-dot lines). As another example, and when the isolation device is in closed state 121 (i.e., prior to receipt of the threshold shockwave), the isolation device may define a first maximum dimension 156, such as an outer diameter 124. Conversely, and when the isolation device is in open state 122 (i.e., subsequent to receipt of the threshold shockwave), the isolation device may define a second maximum dimension 158 that is less than the first maximum dimension. As further illustrated in FIG. 4, and while in closed state 121, outer diameter 124 of isolation device 120 may be greater than a minimum outer diameter 159 of SSP conduit 116. However, when in open state 122, second maximum dimension 158 may be less than minimum outer diameter 159.

Returning to FIG. 2, and as illustrated in dashed lines, SSP 100 also may include a sealing structure 196. Sealing structure 196 may be configured to restrict fluid flow within SSP conduit 116 and past isolation device 120 when the isolation device is in closed state 121. As examples, sealing structure 196 may be configured to form a fluid seal between isolation device 120 and SSP body 110 and/or between isolation device 120 and retention device 130. Examples of sealing structure 196 include any suitable elastomeric sealing structure, polymeric sealing structure, compliant sealing structure, flexible sealing structure, compressible sealing structure, a resin, an epoxy, an adhesive, a gasket, and/or an O-ring.

It is within the scope of the present disclosure that SSP 100 may include a single isolation device 120 or a plurality of isolation devices 120. As an example, SSP 100 may include a first isolation device 120, which may be configured to restrict fluid flow from conduit-facing region 112 and through SSP conduit 116, and a second isolation device 120, which may be configured to restrict fluid flow from formation-facing region 114 and through SSP conduit 116.

When SSP 100 includes the first isolation device and the second isolation device, an intermediate portion of SSP conduit 116 may extend between, or separate, the first isolation device and the second isolation device. Under these conditions, the first isolation device may be configured to resist at least a first threshold static pressure differential between the tubular conduit and the intermediate portion of the SSP conduit. Similarly, the second isolation device may be configured to resist at least a second threshold static pressure differential between the subterranean formation and the intermediate portion of the SSP conduit. Examples of the first threshold static pressure differential and of the second threshold static pressure differential are disclosed herein with reference to the threshold static pressure differential of isolation devices 120.

Retention device 130 may include and/or be any suitable structure that may be adapted, configured, shaped, and/or selected to couple the isolation device to the SSP body and/or to retain the isolation device in the closed state prior to receipt of the threshold shockwave. It is within the scope of the present disclosure that, responsive to receipt of the threshold shockwave, retention device 130 may be configured to release isolation device 120 from SSP 100, such as when isolation device 120 includes isolation disk 126 of FIGS. 2-3. Under these conditions, retention device 130 may change, transition, and/or be deformed upon receipt of the threshold shockwave. As an example, retention device 130 may include at least one shear pin that shears, upon receipt of the threshold shockwave, to release the isolation device. As another example, retention device 130 may include at least one snap ring and corresponding groove, and the snap ring may be displaced from the groove, upon receipt of the threshold shockwave, to release the isolation device. As yet another example, retention device 130 may include a threaded retainer, and the threaded retainer may fail, upon receipt of the threshold shockwave, to release the isolation device.

Additionally or alternatively, it also is within the scope of the present disclosure that retention device 130 may be rigid, may be fixed, may be nonresponsive to (i.e. not damaged by) receipt of the threshold shockwave, and/or may not respond to the threshold shockwave, such as when isolation device 120 includes frangible disk 125 of FIGS. 2 and 4. Under these conditions, isolation device 120 may fragment, fail, or otherwise be displaced from the retention device and the SSP body upon transitioning from the closed state to the open state, as illustrated in FIG. 4.

At least a portion of retention device 130 may be separate and/or distinct from SSP body 110. Additionally or alternatively, at least a portion of retention device 130 may be defined by SSP body 110. As an example, isolation device recess 119 of FIGS. 2-4 may form a portion of retention device 130 and/or may at least partially retain isolation device 120 within SSP 100.

Retention device 130 may include and/or be formed from any suitable material and/or materials, including a magnetic material and/or a radioactive material. Such materials may be detected by shockwave generation device 190, as discussed herein.

Sealing device seat 140 may include any suitable structure that may be defined by conduit-facing region 112 of SSP body 110 and/or that may be adapted, configured, designed, constructed, and/or shaped to form the fluid seal with the sealing device. In addition, sealing device seat 140 may have a preconfigured, pre-established, and/or preselected geometry, such as when the geometry of the sealing device seat is established prior to SSP 100 being operatively attached to wellbore tubular 40 and/or prior to the wellbore tubular being located, installed, and/or positioned within the subterranean formation. Sealing device seat 140 may be erosion-resistant, may be formed from the erosion-resistant material, may be corrosion-resistant, and/or may be formed from the corrosion-resistant material, as discussed herein. Additionally or alternatively, sealing device seat 140 may be defined by a seat body, which may form a portion of SSP body 110 and/or may be erosion-resistant, may be formed from the erosion-resistant material, may be corrosion-resistant, and/or may be formed from the corrosion-resistant material.

Sealing device seat 140 may have, define, and/or include any suitable shape, and the sealing device seat is illustrated in dashed lines in FIGS. 2-3 to illustrate several of these potential shapes. In general, sealing device seat 140 may include and/or be a symmetrical sealing device seat. Examples of the sealing device seat and/or of a shape thereof include a partially spherical sealing device seat, a truncated spherical cap sealing device seat, a conic section sealing device seat, an at least partially cone-shaped sealing device seat, an at least partially funnel-shaped sealing device seat, and/or a tapered sealing device seat. It is within the scope of the present disclosure that the shape of the sealing device seat of each of the plurality of SSPs may be similar, or at least substantially similar. However, this is not required.

As an additional example, and as illustrated in FIG. 2, the sealing device seat may converge, within SSP body 110, from a first diameter 148, which is defined in conduit-facing region 112 of SSP body 110, to a second diameter 149, which is defined within SSP body 110. The first diameter may be greater than the second diameter, and the second diameter may approach, or be, an outer diameter 117 of SSP conduit 116, which also may be referred to herein as an SSP conduit diameter, or average diameter, 117. However, this is not required to all embodiments.

As illustrated in FIG. 2, sealing device 142 may be operatively positioned and/or engaged with sealing device seat 140 to form fluid seal 144. An example of sealing device 142 includes a ball sealer 143 and/or a sealing assembly 920, which is discussed in more detail herein. When sealing device 142 includes ball sealer 143, sealing device seat 140 also may be referred to herein as a ball sealer seat 141, and ball sealer seat 141 may have a ball sealer seat radius of curvature that is equal, or at least substantially equal, to a ball sealer radius of ball sealer 143.

As discussed, SSPs 100 may include and/or be associated with shockwave generation structure 180, which may be adapted, configured, designed, and/or constructed to generate the shockwave. Shockwave generation structure 180 may include and/or be any suitable structure. As examples, shockwave generation structure 180 may include a mechanical shockwave generation structure, such as may be configured to mechanically generate the shockwave, a chemical shockwave generation structure, such as may be configured to chemically generate the shockwave, and/or an explosive shockwave generation structure, such as may be configured to explosively generate the shockwave. When SSPs 100 include shockwave generation structure 180, the SSPs further may include a triggering device 182, which may be configured to actuate the shockwave generation structure, such as to cause the shockwave generation structure to generate the shockwave. Examples of triggering device 182 include any suitable wireless, or wirelessly actuated, triggering device, remote, or remotely actuated, triggering device, and/or wired triggering device.

As illustrated in dashed lines in FIG. 2, SSP 100 further may include a transition assist structure 186. Transition assist structure 186 may be configured to assist and/or facilitate isolation device 120 transitioning from the closed state to the open state responsive to experiencing the threshold shockwave and may include any suitable structure. As an example, transition assist structure 186 may include and/or be a point load, on isolation device 120 that is configured to initiate failure of the isolation device responsive to receiving the threshold shockwave. As another example, transition assist structure 186 may include and/or be a weak point on and/or within isolation device 120 that is configured to initiate failure of the isolation device responsive to receiving the threshold shockwave.

As also illustrated in dashed lines in FIG. 2, SSP 100 may include a barrier material 170. Barrier material 170 may extend at least partially within SSP conduit 116 and may be configured to remain within the SSP conduit during installation of wellbore tubular 40 into the subterranean formation. Such a configuration may protect SSP 100 and/or isolation device 120 thereof from damage during the installation and/or may prevent foreign material from entering at least a portion of the SSP conduit during the installation. In addition, barrier material 170 also may be configured to automatically separate, such as by dissolving, from SSP 100 and/or from SSP conduit 116 thereof responsive, or subsequent, to fluid contact with the wellbore fluid.

Barrier material 170 may be placed and/or present within any suitable portion of SSP conduit 116. As an example, the barrier material may extend between isolation device 120 and conduit-facing region 112 of SSP body 110. As another example, the barrier material may extend between isolation device 120 and formation-facing region 114 of SSP body 110.

Barrier material 170 may include any suitable material and/or materials. As an example, the barrier material may be selected to be, or may be, soluble within the wellbore fluid. More specific examples of barrier material 170 include polyglycolic acid and/or polylactic acid. As another example, barrier material 170 may include and/or be an explosive material. The explosive material may be configured to detonate and/or explode responsive to, responsive to experiencing, and/or responsive to receipt of the threshold shockwave. Examples of the explosive material are disclosed herein.

As illustrated in dashed lines in FIG. 2, SSP 100 also may include a nozzle 160. Nozzle 160 also may be referred to herein as a restriction 161 and may be configured to generate a fluid jet at formation-facing region 114 of SSP body 110 and/or at a formation-facing end of SSP conduit 116. The fluid jet may be generated responsive to fluid flow from tubular conduit 42 and/or into subterranean formation 34 via the SSP conduit.

Figure 5:
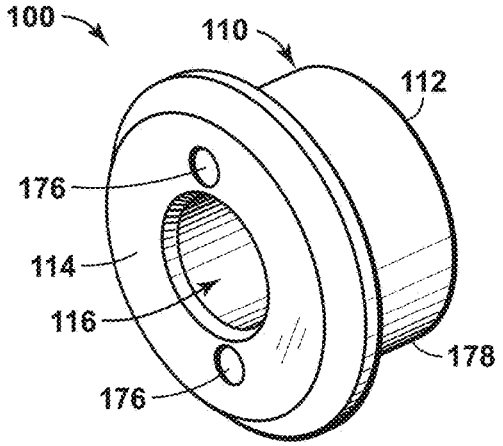
FIG. 5 is a less schematic profile view of a selective stimulation port according to the present disclosure.
Figure 6:
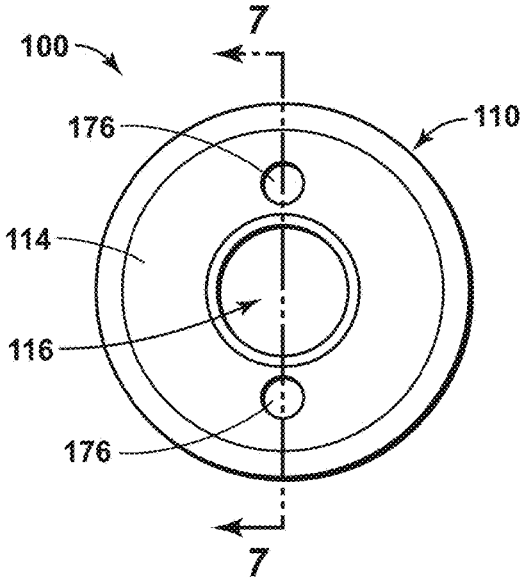
FIG. 6 is a view of a formation-facing side of the selective stimulation port of FIG. 5.

FIG. 5 is a less schematic profile view of a selective stimulation port (SSP) 100 according to the present disclosure, while FIG. 6 is a view of a formation-facing side of the SSP of FIG. 5 and FIG. 7 is a cross-sectional view of the SSP of FIGS. 5-6 taken along line 7-7 of FIG. 6. SSP 100 of FIGS. 5-7 may include and/or be a more detailed illustration of SSPs 100 of FIGS. 1-4, and any of the structures, functions, and/or features discussed herein with reference to any of FIGS. 1-4 may be included in and/or utilized with SSP 100 of FIGS. 5-7 without departing from the scope of the present disclosure. Similarly, any of the structures, functions, and/or features of SSP 100 of FIGS. 5-7 may be included in and/or utilized with SSPs 100 of FIGS. 1-4 without departing from the scope of the present disclosure.

As illustrated in FIGS. 5-7, SSP 100 includes an SSP body 110 that defines an SSP conduit 116. SSP body 110 has a conduit-facing region 112 and an opposed formation-facing region 114. SSP body 110 also has a projecting region 150, which projects from SSP body 110 in a direction that is away from, or perpendicular to, a central axis 118 of SSP conduit 116.

SSP 100 also includes a tool-receiving portion 176, which may be configured to receive a tool during operative attachment of the SSP to a wellbore tubular, and an attachment region 178, which may be configured to interface with the wellbore tubular when the SSP is operatively attached to the wellbore tubular. As an example, attachment region 178 may include threads, and SSP 100 may be configured to be rotated, via receipt of the tool within tool-receiving portion 176, to permit threading of the SSP into the wellbore tubular.

Figure 9:
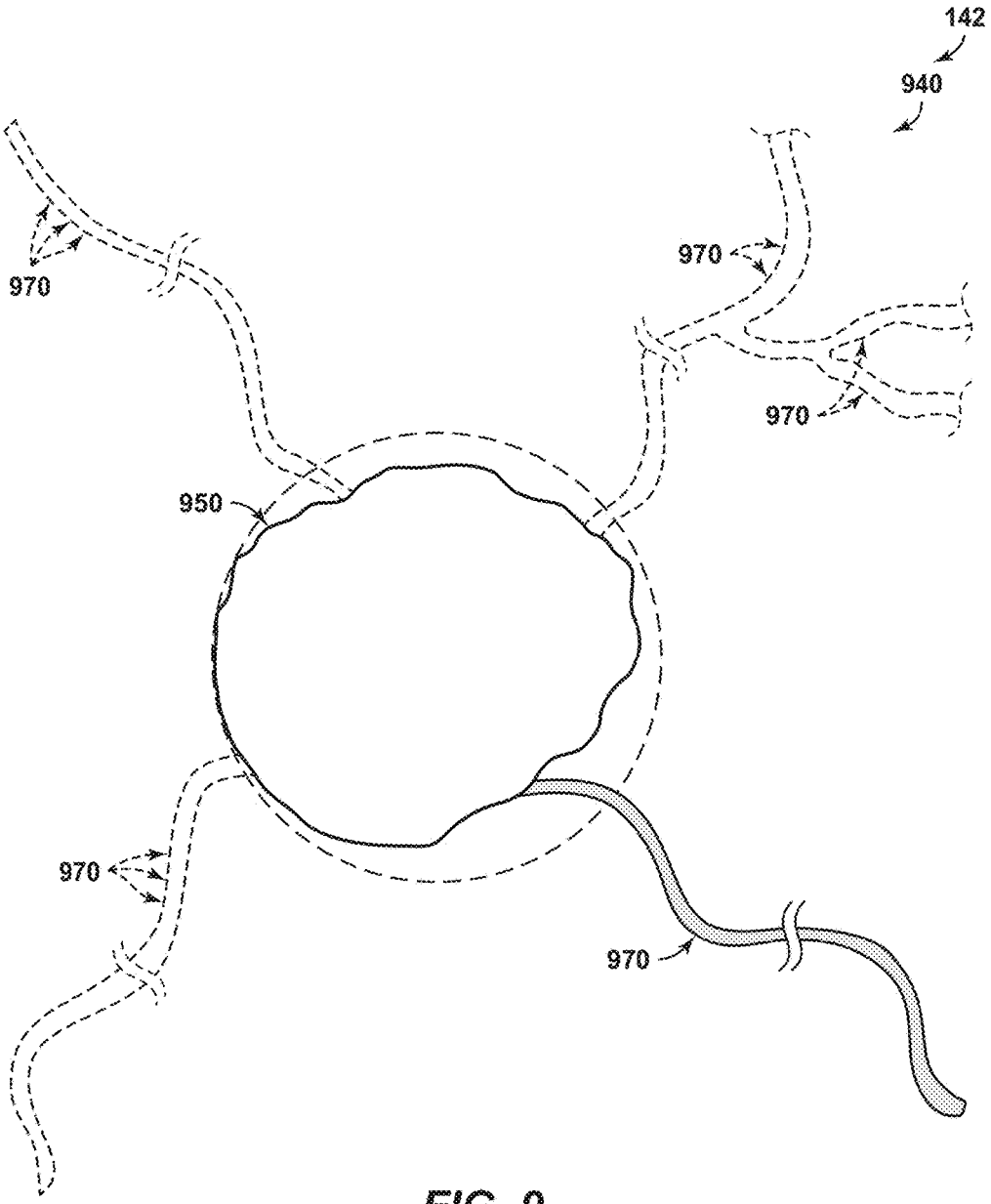
FIG. 9 is another schematic representation illustrating examples of a sealing assembly according to the present disclosure.

As perhaps illustrated most clearly in FIG. 9, SSP 100 further includes a sealing device seat 140, which may be configured to receive a sealing device 142, and an isolation device 120. In FIG. 9, isolation device 120 is illustrated in closed state 121.

Figure 8:
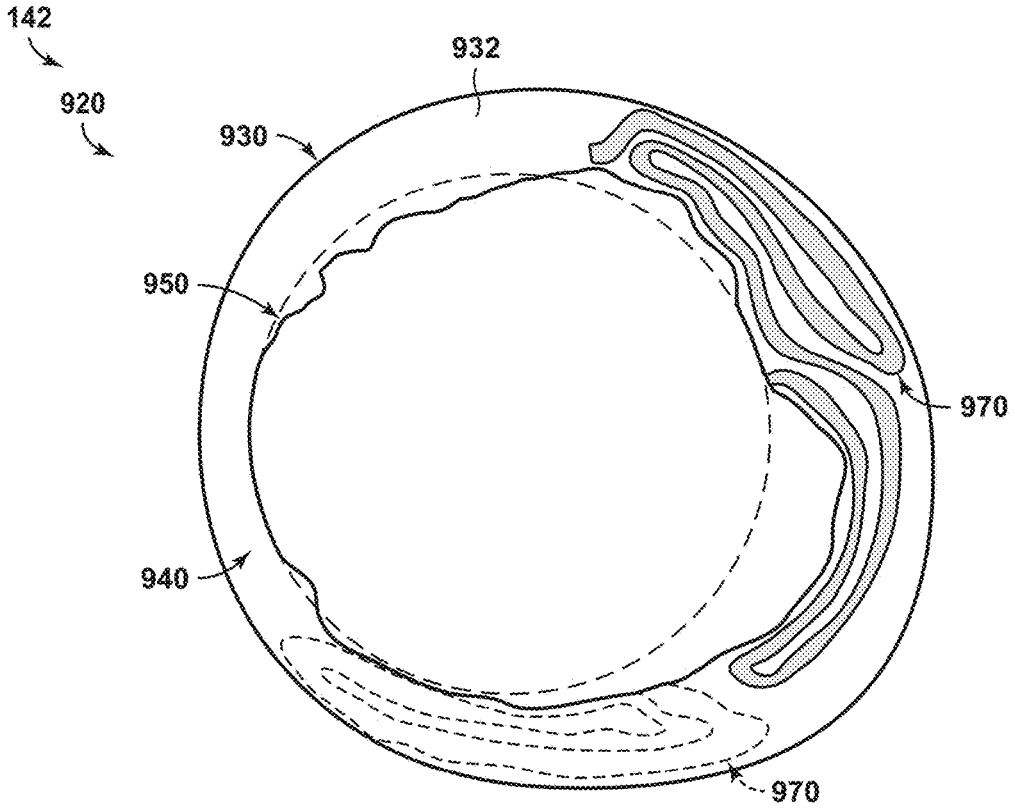
FIG. 8 is a schematic representation illustrating examples of a sealing device according to the present disclosure, still contained within a delivery shell.
Figure 10:
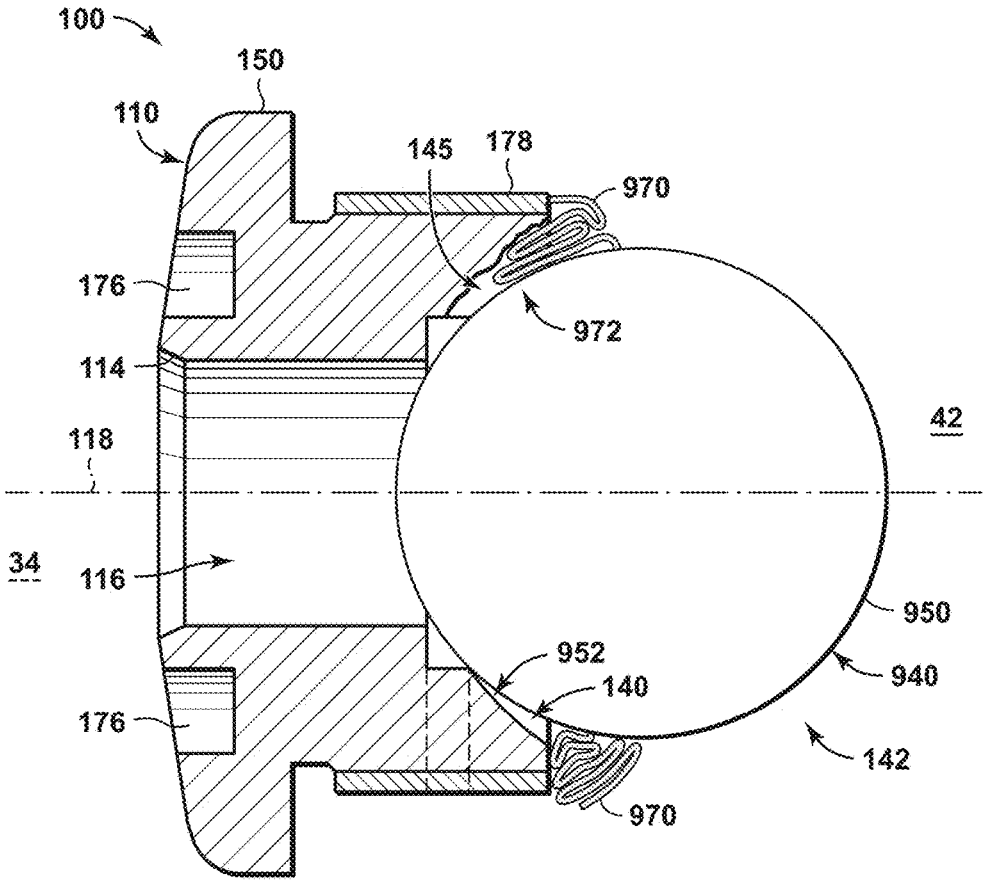
FIG. 10 is a schematic representation of a sealing assembly seated upon a sealing device seat of a selective stimulation port, according to the present disclosure.

FIGS. 8-10 provide examples of a sealing device 142, which also may be referred to herein as a sealing device 940, that may be included in and/or utilized with the wellbore tubulars and/or methods according to the present disclosure. More specifically, FIG. 8 is a schematic representation illustrating examples of a sealing assembly 920 that includes sealing device 940, FIG. 9 is a schematic representation illustrating examples of sealing device 940, and FIG. 10 is a schematic representation of sealing device 940 seated upon a sealing device seat 140 of a selective stimulation port 100, according to the present disclosure. As illustrated in FIGS. 8-10, sealing devices 940 include a primary sealing portion 950 and a secondary sealing portion 970, which extends from primary sealing portion 950.

As illustrated in FIG. 8, sealing device 940 may, but is not required in all embodiments, form a portion of a sealing assembly 920 that includes both sealing device 940 and a shell 930. Shell 930 defines an enclosed volume 932 and sealing device 940, including both primary sealing portion 950 and secondary sealing portion 970 thereof, is positioned within the enclosed volume. Shell 930 may be configured to retain, or house, sealing device 940 within enclosed volume 932 and to release the sealing device from the enclosed volume responsive to receipt of a release stimulus. Such a configuration may facilitate positioning of one or more sealing devices 940 within a wellbore tubular. As an example, sealing assemblies 920 may be easier to handle, transport, and/or inject into the wellbore tubular when compared to sealing devices 940 that are not enclosed within a corresponding shell 930. As another example, the presence of shell 930 may permit one or more sealing assemblies 920 to be positioned within the wellbore tubular without the one or more sealing devices 940 thereof becoming entangled with one another and/or with another structure of a hydrocarbon well that includes the wellbore tubular. As another example, shell 930 may prevent contact between the wellbore fluid and the sealing device, at least until receipt of the release stimulus and/or separation of the sealing device from the enclosed volume of the shell.

However, and subsequent to being positioned within the tubular conduit and/or subsequent to being positioned within a desired region of the tubular conduit, shell 930 may receive the release stimulus, thereby causing sealing device 940 to be released from enclosed volume 932 and/or permitting sealing device 940 to seal a corresponding SSP 100, as discussed in more detail herein with reference to FIG. 10. Examples of the release stimulus include one or more of a fluid shear force experienced by the shell, a fluid shear force experienced by the shell that exceeds a threshold fluid shear force, fluid contact between the shell and an acidic solution, fluid contact between the shell and the acidic solution for greater than a threshold solution contact time, fluid contact between the shell and water, fluid contact between the shell and water for greater than a threshold water contact time, fluid contact between the shell and a hydrocarbon fluid, fluid contact between the shell and the hydrocarbon fluid for greater than a threshold hydrocarbon fluid contact time, receipt of a shockwave by the shell, receipt of a shockwave with greater than a threshold shockwave intensity by the shell, receipt of a mechanical force by the shell, receipt of the mechanical force with greater than a threshold force intensity by the shell, receipt of a pressure force by the shell, and/or receipt of the pressure force with greater than a threshold pressure intensity by the shell.

Shell 930 may include and/or be formed from any suitable material and/or materials. As examples, shell 930 may include one or more of an acid-soluble material, a water-soluble material, a hydrocarbon-soluble material, a nylon, a polyglycolic acid (PGA), a polylactic acid (PLA), and/or a frangible material. Similarly, shell 930 may have any suitable material property and/or properties. As examples, shell 930 may be rigid, flexible, compliant, resilient, and/or frangible. In addition, shell 930 may have and/or define any suitable shape. As examples, shell 930 may be spherical, at least partially spherical, and/or hollow spherical.

Subsequent to being separated, or released, from enclosed volume 932 of shell 930, primary sealing portion 950 and secondary sealing portion 970 may be operatively attached to one another. However, at least a portion of secondary sealing portion 970 may be configured to move and/or flow at least partially independently from primary sealing portion 950. This is illustrated in FIG. 9, where secondary sealing portions 970 extend from primary sealing portion 950 to an extent that is greater than the extent to which secondary sealing portions 970 extend from primary sealing portion 950 in FIG. 8.

As illustrated in FIG. 10, primary sealing portion 950 may be seated on a corresponding sealing device seat 140 of a corresponding SSP 100 and forms a primary seal 952 with the sealing device seat. The primary seal at least partially, or even completely, restricts fluid flow through an SSP conduit 116 of the SSP.

However, as discussed herein, the primary fluid seal may be imperfect and/or may permit some fluid flow therepast, such as from tubular conduit 42 into subterranean formation 34. As an example, a leakage pathway 145 may extend between primary sealing portion 950 and sealing device seat 140 and may permit fluid communication between tubular conduit 42 and subterranean formation 34. The leakage pathway may be present due to a variety of factors. As an example, primary sealing portion 950 may be misshapen, may not have a shape that corresponds to, or complements, sealing device seat 140, and/or may be deformed. As another example, a foreign object, such as particulate material, may extend between at least a portion of primary sealing portion 950 and sealing device seat 140, thereby preventing formation of a complete and/or uniform fluid seal 144. As yet another example, sealing device seat 140 may be misshapen, may not have a shape that corresponds to, or complements, primary sealing portion 950, may be deformed, may be corroded, such as by a corrosive reservoir fluid, and/or may be eroded, such as by an erosive mixture, slurry, and/or proppant.

Under these conditions, secondary sealing portion 970 may form a secondary seal 972 between primary sealing portion 950 and sealing device seat 140. This secondary seal may at least partially block, seal, and/or restrict fluid flow through leakage pathway 145, thereby decreasing, or even eliminating, fluid flow from tubular conduit 42 into subterranean formation 34 via SSP conduit 116.

Primary sealing portion 950 may include any suitable structure that may be adapted, configured, designed, constructed, and/or sized to form the primary fluid seal with sealing device seat 140. As examples, primary sealing portion 950 may include and/or be a bulbous primary sealing portion, an at least partially spherical primary sealing portion, and/or an egg-shaped primary sealing portion. FIGS. 8-9 illustrate primary sealing portion 950 in both solid and dashed lines to illustrate that a variety of shapes, including more bulbous, as illustrated in solid lines, and/or more circular/spherical, as illustrated in dashed lines, are within the scope of the present disclosure.

In general, primary sealing portion 950 is configured to form primary fluid seal 952 with sealing device seat 140 and to resist extrusion, or flow, through SSP conduit 116. As an example, primary sealing portion 950 may have and/or define a primary sealing portion effective radius, sealing device seat 140 may have and/or define a seat radius of curvature, and the primary sealing portion effective radius may be at least substantially similar to, or greater than, the seat radius of curvature. As another example, primary sealing portion 950 may be larger than SSP conduit 116 such that the primary sealing portion is sized to resist flow, or extrusion, through the SSP conduit.

It is within the scope of the present disclosure that primary sealing portion 950 may be formed from any suitable material and/or materials and/or that the primary sealing portion may have, or exhibit, any suitable material property and/or properties. As examples, primary sealing portion 950 may include and/or be formed from one or more of an acid-soluble material, a water-soluble material, a hydrocarbon-soluble material, a nylon, a polyglycolic acid (PGA), a polylactic acid (PLA), and/or a frangible material. As additional examples, primary sealing portion 950 may be rigid, compliant, resilient, and/or flexible.

Secondary sealing portion 970 may include any suitable structure that may be adapted, configured, designed, constructed, and/or sized to form the secondary fluid seal between the primary sealing portion and the sealing device seat and/or to resist the fluid flow through the leakage pathway. As examples, and as perhaps best illustrated in FIG. 9, secondary sealing portions 970 may be elongate, tentacular, fibrous, dendritic, branched, and/or tendrilous.

It is within the scope of the present disclosure that sealing device 940 may include any suitable number of secondary sealing portions 970. As examples, sealing device 940 may include a single secondary sealing portion 970, a plurality of secondary sealing portions 970, at least 2, at least 3, at least 4, at least 6, at least 8, at least 10, or more than 10 secondary sealing portions 970. Similar to primary sealing portion 950, secondary sealing portion 970 may include and/or be formed from one or more of an acid-soluble material, a water-soluble material, a hydrocarbon-soluble material, a nylon, a polyglycolic acid (PGA), a polylactic acid (PLA), and/or a frangible material.

It is within the scope of the present disclosure that secondary sealing portion 970 may have and/or define any suitable size, dimension, and/or dimension relative to a dimension of primary sealing portion 950. As an example, a ratio of a maximum dimension of secondary sealing portion 970 to a maximum dimension of primary sealing portion 950 may be at least 0.1, at least 0.2, at least 0.4, at least 0.6, at least 0.8, at least 1, at most 1, at most 2, at most 4, at most 6, at most 8, at most 10, at most 15, at most 20, and/or more than 20. Examples of the maximum dimension of the primary sealing portion include a diameter of the primary sealing portion, an effective diameter of the primary sealing portion, and a diameter of a sphere that has the same volume as that of the primary sealing portion. Examples of the maximum dimension of the secondary sealing portion include a maximum distance that the secondary sealing portion may extend from the primary sealing portion, an average of the maximum distance that each of the plurality of secondary sealing portions extends from the primary sealing portion, an elongate length of the secondary sealing portion, and/or an average of the elongate length of each of the plurality of secondary sealing portions.

As another example, a ratio of a volume of the primary sealing portion to a volume of the secondary sealing portion may be at least 1, at least 2, at least 4, at least 10, at least 20, at least 30, at least 40, at most 500, at most 400, at most 300, at most 200, at most 100, and/or at most 50. As yet another example, a surface area to volume ratio of the secondary sealing portion may be at least 1, at least 2, at least 4, at least 6, at least 8, at least 10, at least 15, at least 20, or more than 20 times larger than a surface area to volume ratio of the primary sealing portion.

It is within the scope of the present disclosure that primary sealing portion 950 and secondary sealing portion 970 may be defined by a single, unitary, and/or monolithic body. As an example, the primary sealing portion and the secondary sealing portion may be molded and/or extruded from a single, or common, material and/or materials. As another example, an elongate body may define at least a portion of both the primary sealing portion and the secondary sealing portion, with the elongate body being knotted and/or otherwise wrapped around itself to define the primary sealing portion. Alternatively, it is also within the scope of the present disclosure that the secondary sealing portion may be operatively attached to the primary sealing portion to form and/or define the sealing device.

Sealing devices 940 disclosed herein are described as being utilized to seal SSPs 100. It is within the scope of the present disclosure that sealing devices 940 additionally or alternatively may be utilized to seal one or more other fluid conduits that extend between tubular conduit 42 and subterranean formation 34. As an example, and subsequent to being utilized to stimulate the subterranean formation, one or more SSPs 100 may be damaged such that the one or more SSPs no longer includes a corresponding sealing device seat 140. Under these conditions, sealing devices 940 still may be utilized to seat upon a remainder of the damaged SSP and/or to seal the SSP conduit that is associated with the damaged SSP.

As another example, and subsequent to being utilized to stimulate the subterranean formation, one or more SSPs may physically separate from wellbore tubular 40 leaving behind a corresponding tubular aperture 48, which is illustrated in FIG. 2. Under these conditions, sealing devices 940 may be utilized to seal the tubular aperture.

As yet another example, one or more perforations may be formed within wellbore tubular 40, and sealing devices 940 may be utilized to seal the one or more perforations. As another example, a portion of tubular conduit 40 may fail and/or rupture, and sealing devices 940 may be utilized to seal the failed and/or ruptured tubular conduit.

It is also within the scope of the present disclosure that sealing devices 940 may be included in and/or utilized with other and/or additional structures and/or methods that may form a portion of a hydrocarbon well, such as hydrocarbon well 10 of FIG. 1. Examples of such additional structures and/or methods are disclosed in U.S. Provisional Patent Application Nos. 62/262,034 and 62/262,036, which were filed on Dec. 2, 2015, and U.S. Provisional Patent Application No. 62/263,069, which was filed on Dec. 4, 2015, and the complete disclosures of which are hereby incorporated by reference.

Figure 11:
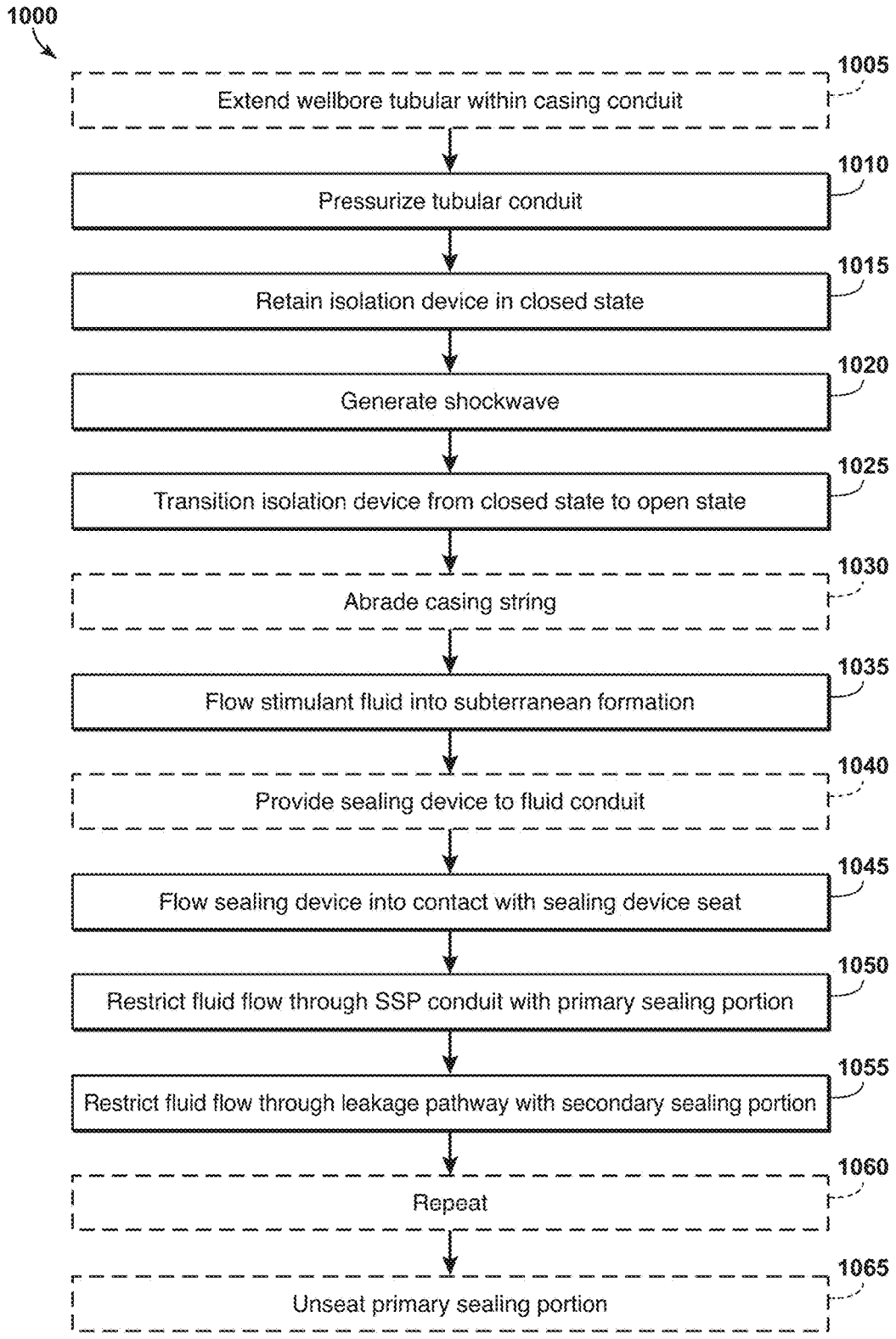
FIG. 11 is a flowchart depicting methods, according to the present disclosure, of stimulating a subterranean formation.

FIG. 11 is a flowchart depicting methods 1000, according to the present disclosure, of stimulating a subterranean formation. Methods 1000 may be performed with and/or may utilize wellbore tubulars 40, selective stimulation ports 100, and/or sealing devices 940, which are disclosed herein; and FIGS. 12-17 provide schematic cross-sectional views of portions of process flows for stimulating a subterranean formation 34 utilizing wellbore tubulars 40, selective stimulation ports 100, sealing devices 940, and/or methods 1000 according to the present disclosure.

Methods 1000 may include extending a wellbore tubular within a casing conduit at 1005 and include pressurizing a tubular conduit at 1010, retaining an isolation device in a closed state at 1015, generating a shockwave at 1020, and transitioning the isolation device from the closed state to an open state at 1025. Methods 1000 further may include abrading a casing string at 1030, include flowing a stimulant fluid into a subterranean formation at 1035, and may include providing a sealing device to the tubular conduit at 1040. Methods 1000 further include flowing the sealing device into contact with a sealing device seat at 1045, restricting fluid flow through an SSP conduit with a primary sealing portion at 1050, and restricting fluid flow through a leakage pathway with a secondary sealing portion at 1055. Methods 1000 further may include repeating at least a portion of the methods at 1060 and/or unseating the primary sealing portion from the sealing device seat at 1065.

Extending the wellbore tubular within the casing conduit at 1005 may include extending the wellbore tubular within a casing conduit that is defined by a casing string that extends within the subterranean formation. The casing string may be preexisting, may be present within the subterranean formation prior to the extending at 1005, and/or previously may have been utilized to stimulate the subterranean formation and/or to produce reservoir fluids from the subterranean formation. The wellbore tubular may include one or more SSPs.

Pressurizing the tubular conduit at 1010 may include pressurizing the tubular conduit with a stimulant fluid and/or pressurizing the tubular conduit to at least a threshold pressure. Examples of the threshold pressure include threshold pressures of at least 1 megapascal, at least 5 megapascals, at least 10 megapascals, at least 20 megapascals, at least 30 megapascals, at least 40 megapascals, or at least 50 megapascals. When methods 1000 include the extending at 1005, the pressurizing at 1010 may include pressurizing the tubular conduit with a stimulant fluid that includes an abrasive material.

Figure 12:
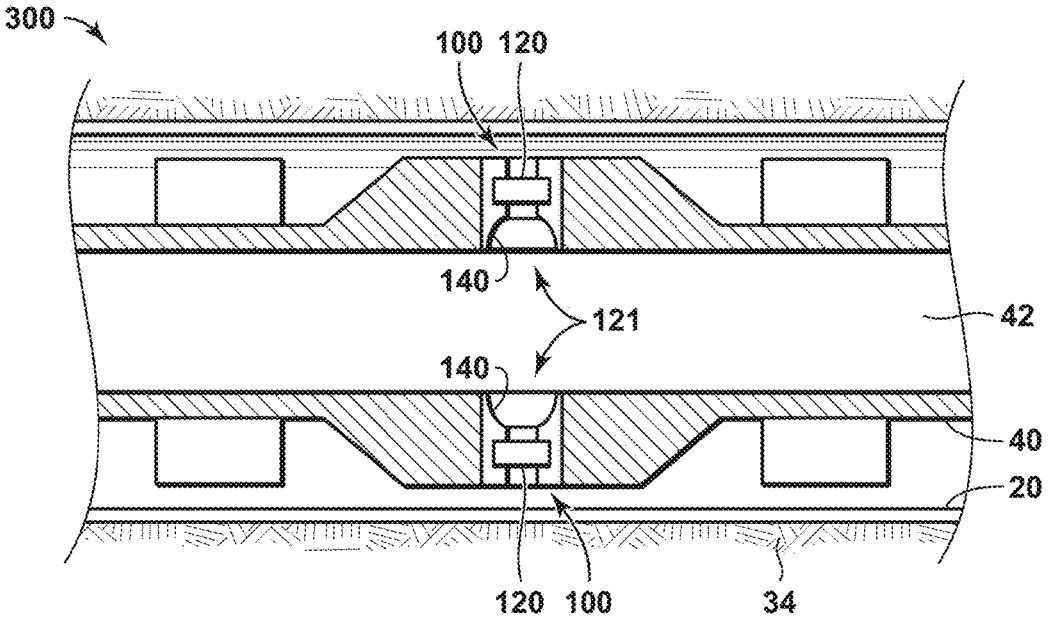
FIG. 12 is a schematic cross-sectional view of a portion of a process flow for stimulating a subterranean formation utilizing the selective stimulation ports, wellbore tubulars, sealing devices, and/or methods according to the present disclosure.

Retaining the isolation device in the closed state at 1015 may include retaining the isolation device in the closed state during the pressurizing at 1010. Stated another way, the retaining at 1015 may include resisting fluid flow from the tubular conduit and into the subterranean formation, via the SSP conduit of the SSP, during the pressurizing at 1010 and/or prior to the generating at 1020. This is illustrated in FIG. 12, with SSP 100 being in closed state 121 during pressurization of tubular conduit 42.

Figure 14:
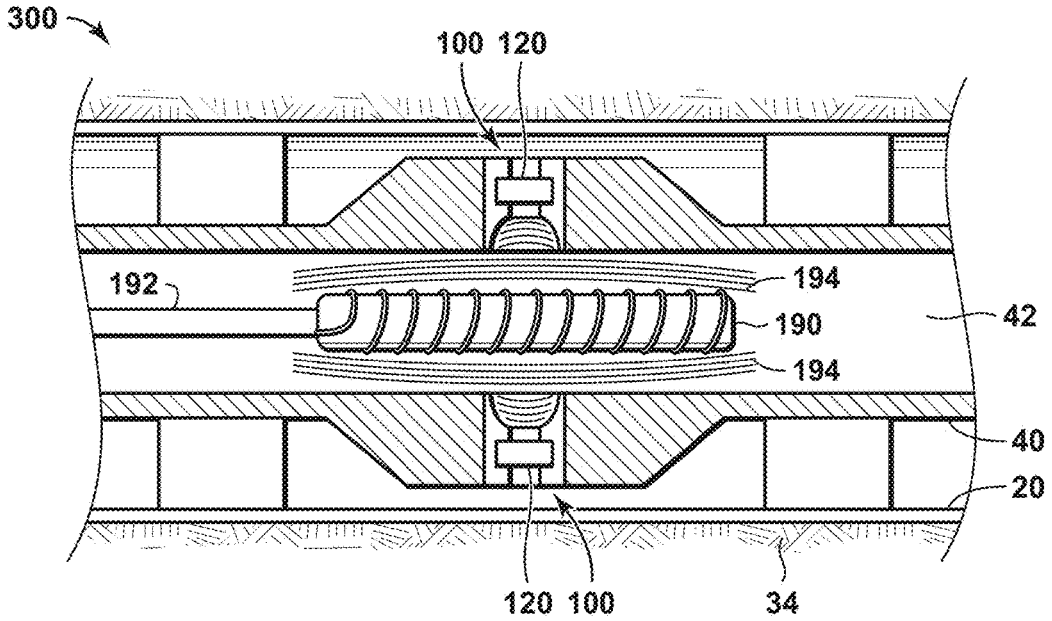
FIG. 14 is a schematic cross-sectional view of a portion of the process flow for stimulating the subterranean formation utilizing the selective stimulation ports, wellbore tubulars, sealing devices, and/or methods according to the present disclosure.

Generating the shockwave at 1020 may include generating the shockwave within a wellbore fluid that extends within the tubular conduit. In addition, the generating at 1020 may include generating within a region of the tubular conduit that is proximal the SSP such that a magnitude of the shockwave, as received by the SSP, is greater than a threshold shockwave intensity that is sufficient to transition the isolation device of the SSP from the closed state to the open state (i.e., such that the SSP receives and/or experiences the threshold shockwave). This is illustrated in FIG. 14 by the generation of a shockwave 194 with shockwave generation device 190.

Figure 13:
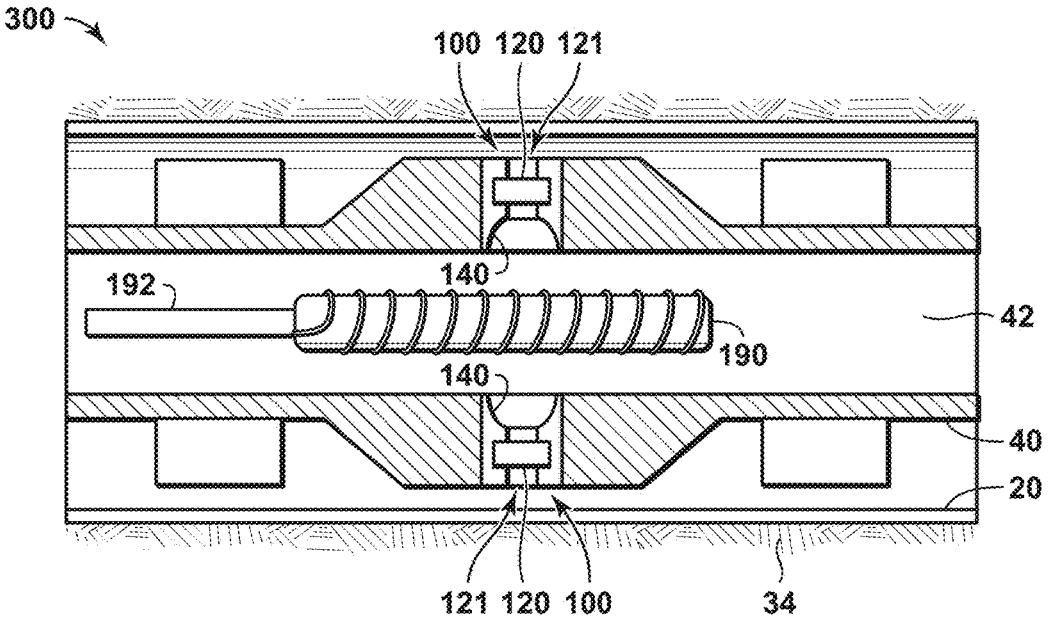
FIG. 13 is a schematic cross-sectional view of a portion of the process flow for stimulating the subterranean formation utilizing the selective stimulation ports, wellbore tubulars, sealing devices, and/or methods according to the present disclosure.

The generating at 1020 may be accomplished in any suitable manner. As an example, the generating at 1020 may include detonating an explosive charge within the tubular conduit. The explosive charge may be associated with and/or may form a portion of the shockwave generation device, which is separate from the SSP, as illustrated in FIGS. 13-14. Additionally or alternatively, the explosive charge may be associated with and/or may form a portion of a shockwave generation structure, which forms a portion of the SSP and is illustrated in FIG. 2 at 180. As another example, the generating at 1020 may include actuating a triggering device, such as a blast cap. The actuating may include remotely actuating and/or wirelessly actuating the triggering device.

When the generating at 1020 includes generating with the shockwave generation device, the shockwave generation device may be located within the tubular conduit such that the shockwave has greater than the threshold shockwave intensity within the wellbore fluid that extends within the tubular conduit and in contact with the isolation device. In addition, the shockwave may have less, may have decayed to less, and/or may have been attenuated to less than the threshold shockwave intensity at a distance that is greater than a maximum effective distance from the shockwave generation device. Examples of the maximum effective distance are disclosed herein.

It is within the scope of the present disclosure that the generating at 1020 may include generating such that the shockwave emanates at least substantially symmetrically from the shockwave generation device and/or such that the shockwave emanates at least substantially isotropically from the shockwave generation device. Additionally or alternatively, the generating at 1020 may include generating such that the shockwave is symmetrical, or at least substantially symmetrical, within a given transverse cross-section of the tubular conduit and/or such that the shockwave has a constant, or at least substantially constant, magnitude within the given transverse cross-section of the tubular conduit at a given point in time.

The shockwave may have any suitable maximum shockwave pressure and/or maximum shockwave duration that is sufficient to transition the isolation device from the closed state to the open state but insufficient to cause damage to the wellbore tubular. Examples of the maximum shockwave pressure and/or of the maximum shockwave duration are disclosed herein.

The generating at 1020 further may include propagating the shockwave within the wellbore fluid. As examples, the propagating may include propagating the shockwave from the shockwave generation device, propagating the shockwave to the SSP, propagating the shockwave to the isolation device of the SSP, and/or propagating the shockwave in and/or within the wellbore fluid.

As discussed, the shockwave may be attenuated during propagation. As an example, the shockwave may be attenuated by and/or within the wellbore fluid. This may include dissipating at least a portion of the shockwave within the wellbore fluid and/or absorbing energy from the shockwave with the wellbore fluid. The shockwave may be attenuated at any suitable attenuation rate, examples of which are disclosed herein.

Transitioning the isolation device from the closed state to the open state at 1025 may include transitioning to permit fluid communication between the tubular conduit and the subterranean formation via the SSP conduit. The transitioning at 1025 may be at least partially responsive to the generating at 1020. As an example, the transitioning may be initiated and/or triggered by receipt of the threshold shockwave with and/or by the isolation device.

The transitioning at 1025 may be accomplished in any suitable manner. As an example, the transitioning at 1025 may include shattering a frangible disk that defines at least a portion of the isolation device. As another example, the transitioning at 1025 may include displacing an isolation disk, which defines at least a portion of the isolation device, from the SSP conduit. The displacing may include shearing a pin that retains the isolation disk within the SSP conduit and/or defeating a clip that retains the isolation device within the SSP conduit.

When methods 1000 include the extending at 1005, methods 1000 further may include abrading the casing string at 1030. The abrading at 1030 may include abrading the casing string with the stimulant fluid and/or with the abrasive material, such as to form a hole in the casing string and/or to establish fluid communication between the casing conduit and the subterranean formation via the hole that is formed in the casing string during the abrading at 1030.

Figure 15:
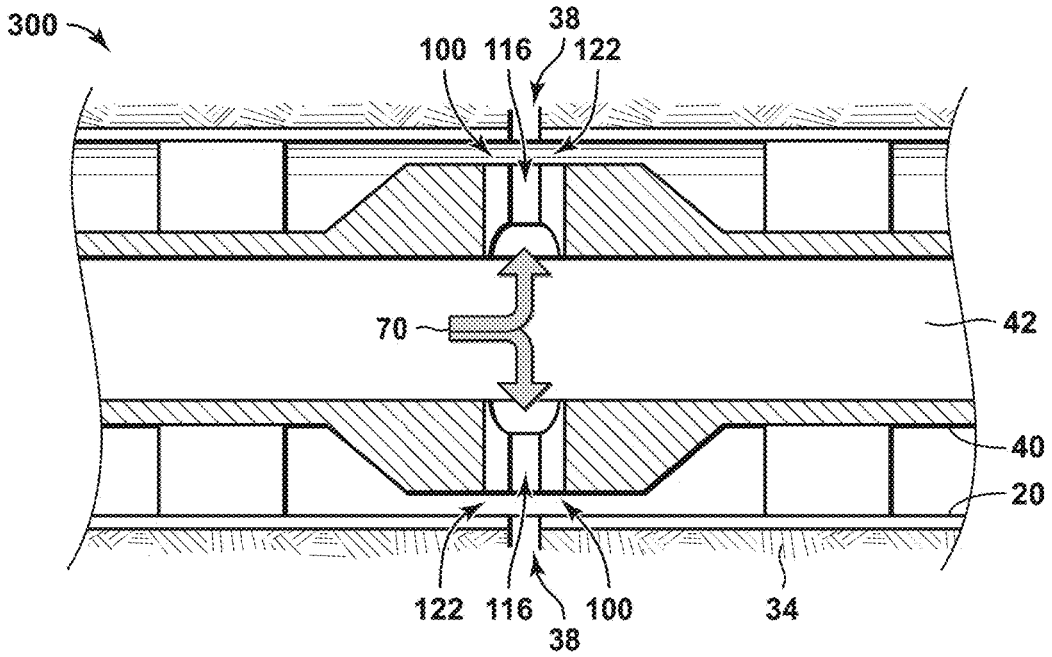
FIG. 15 is a schematic cross-sectional view of a portion of the process flow for stimulating the subterranean formation utilizing the selective stimulation ports, wellbore tubulars, sealing devices, and/or methods according to the present disclosure.

Flowing the stimulant fluid into the subterranean formation at 1035 may include may include flowing the stimulant fluid, via the SSP conduit, from the tubular conduit and/or into the subterranean formation, such as to stimulate the subterranean formation. The flowing at 1035 is illustrated in FIG. 15, with stimulant fluid 70 flowing into subterranean formation 34 via SSP conduit 116. The flowing at 1035 further may include accelerating the stimulant fluid, such as via and/or utilizing a nozzle of the SSP.

When methods 1000 include the extending at 1005, the flowing at 1035 further may include flowing such that the stimulant fluid and/or the abrasive material impinges upon an inner casing surface of the casing string, such as to permit and/or facilitate the abrading at 1030. Under these conditions, the flowing the stimulant fluid into the subterranean formation may be subsequent, or responsive, to the abrading at 1030 and/or subsequent to formation of the hole during the abrading at 1030. Stated another way, and when methods 1000 include the extending at 1005 and/or the abrading at 1030, the flowing the stimulant fluid into the subterranean formation at 1035 may include flowing through and/or via the hole that is formed during the abrading at 1030.

Providing the sealing device to the tubular conduit at 1040 may include providing the sealing device, or positioning the sealing device within the tubular conduit, in any suitable manner. As an example, the providing at 1040 may include providing the sealing device from a surface region. As another example, the providing at 1040 may include providing the sealing device from a sealing device compartment.

When the providing at 1040 includes providing the sealing device from the sealing device compartment, the sealing device compartment may be present in any suitable portion and/or region of the hydrocarbon well. As an example, the sealing device compartment may be located and/or positioned within the surface region and selectively may be utilized to introduce a sealing device into the tubular conduit. As another example, the sealing device compartment may be operatively attached to the shockwave generation device and may be configured to selectively release the sealing device from the shockwave generation device. As yet another example, the sealing device compartment may be operatively attached to, or may form a portion of, the wellbore tubular.

It is within the scope of the present disclosure that the providing at 1040 may include providing a sealing assembly, such as sealing assembly 920 of FIGS. 8-10, that includes both the sealing device and a shell. As discussed herein, the shell may define an enclosed volume and the sealing device initially may be contained within the enclosed volume. Under these conditions, the providing at 1040 further may include applying a release stimulus to the shell to release the sealing device from the shell. Examples of the release stimulus are disclosed herein.

Flowing the sealing device into contact with the sealing device seat at 1045 may include flowing any suitable sealing device, such as sealing device 940 of FIGS. 8-10, via and/or along a length of the tubular conduit and into contact and/or engagement with the sealing device seat of the SSP. This is illustrated in FIG. 15. Therein, a sealing device 142 is illustrated as flowing into contact and engaging with a sealing device seat 140 of SSP 100. The flowing at 1045 may include flowing within and/or via the stimulant fluid and/or may be performed subsequent to performing the flowing at 1035 for at least a threshold stimulation time.

Figure 16:
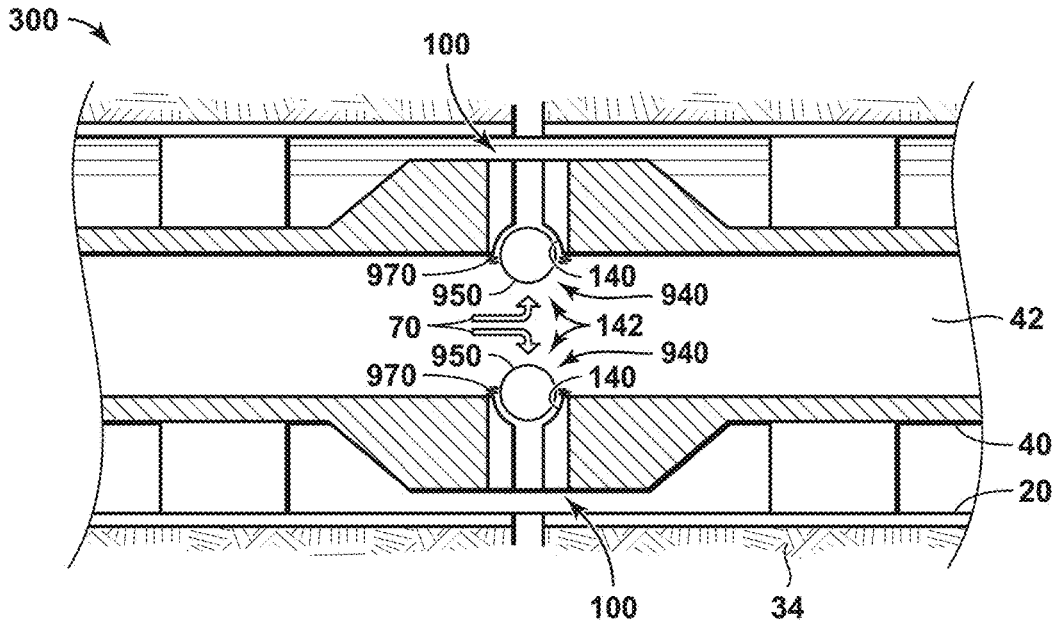
FIG. 16 is a schematic cross-sectional view of a portion of the process flow for stimulating the subterranean formation utilizing the selective stimulation ports, wellbore tubulars, and/or methods according to the present disclosure.

As discussed in more detail herein with reference to FIGS. 8-10, the sealing device may include a primary sealing portion and a secondary sealing portion that extends from the primary sealing portion. The primary sealing portion may be configured to seat upon the sealing device seat, and the restricting at 1050 may include at least partially restricting fluid flow through the SSP conduit with the primary sealing portion. The at least partially restricting fluid flow may include one or more of seating the primary sealing portion on the sealing device seat, mechanically contacting the primary sealing portion with the sealing device seat, and/or deforming the primary sealing portion via physical contact with the sealing device seat. This is illustrated in FIG. 16, where primary sealing portion 950 of sealing device 940 is seated upon sealing device seat 140 and forms an at least partial fluid seal with the sealing device seat.

Restricting fluid flow through the leakage pathway with the secondary sealing portion at 1055 may include blocking and/or occluding, with the secondary sealing portion, a leakage pathway that extends between the primary sealing portion and the sealing device seat. The restricting at 1055 may include one or more of flossing the secondary sealing portion into a gap between the primary sealing portion and the sealing device seat, compressing the secondary sealing portion between the primary sealing portion and the sealing device seat, and/or mechanically contacting at least a first region of the secondary sealing portion with the sealing device seat and also mechanically contacting at least a second region of the secondary sealing portion with the primary sealing portion. This is illustrated in FIG. 16, where secondary sealing portion 970 extends across a gap and/or leakage pathway between primary sealing portion 950 and sealing device seat 150.

Repeating at least a portion of the methods at 1060 may include repeating any suitable portion of methods 1000 in any suitable order and/or in any suitable manner. As an example, the SSP may be a first SSP of a plurality of spaced-apart SSPs that are spaced-apart along a longitudinal length of the wellbore tubular. Under these conditions, the repeating at 1060 may include repeating at least the pressurizing at 1010, the retaining at 1015, the generating at 1020, the transitioning at 1025, the flowing at 1035, the flowing at 1045, the restricting at 1050, and the restricting at 1055 to stimulate a portion of the subterranean formation that is proximal, or associated with, a second SSP of the plurality of spaced-apart SSPs. This may include selectively transitioning the second SSP from the closed state to the open state without transitioning another SSP of the plurality of spaced-apart SSPs from the closed state to the open state. Stated another way, the repeating at 1060 may include repeating without stimulating a portion of the subterranean formation that is proximal, or associated with, a third SSP of the plurality of spaced-apart SSPs.

Figure 17:
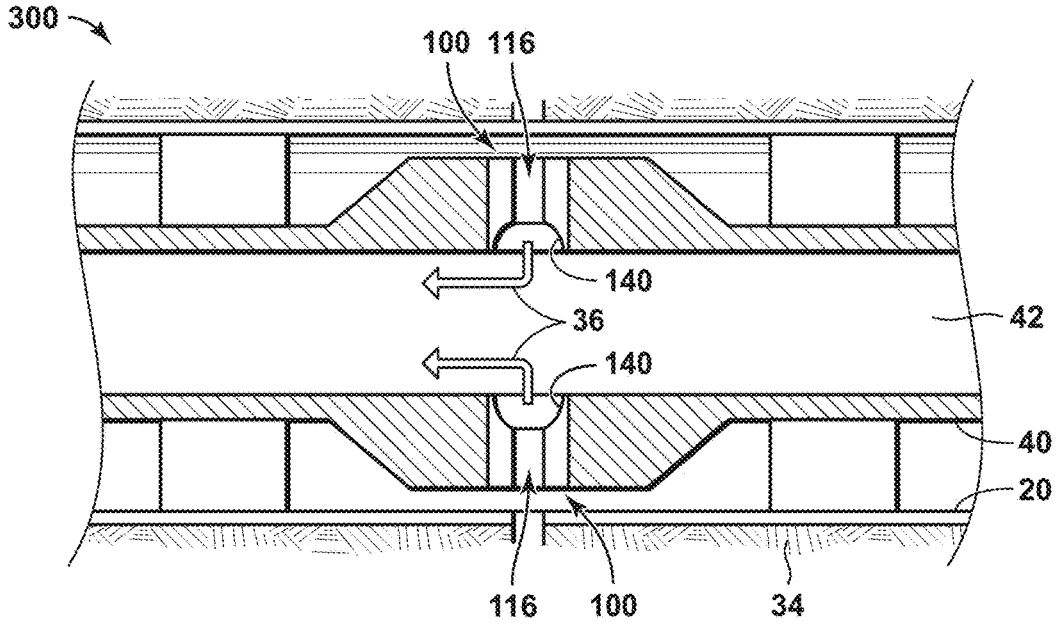
FIG. 17 is a schematic cross-sectional view of a portion of the process flow for stimulating the subterranean formation utilizing the selective stimulation ports, wellbore tubulars, sealing devices, and/or methods according to the present disclosure.

Unseating the primary sealing portion from the sealing device seat at 1065 may include separating the sealing device from the sealing device seat, such as to permit and/or facilitate production of a reservoir fluid from the subterranean formation. This is illustrated in FIG. 17, with sealing device 940 of FIG. 15 having been separated from sealing device seat 140 and reservoir fluid 36 flowing into tubular conduit 42 via SSP conduit 116.

The unseating at 1065 may be accomplished in any suitable manner. As an example, the restricting at 1050 and the restricting at 1055 may include seating the primary sealing portion of the sealing device seat via application of a seating pressure differential between the tubular conduit and the subterranean formation. The seating pressure differential may be such that the pressure within the tubular conduit is greater than the pressure within the subterranean formation, thereby providing a pressure force for seating of the primary sealing portion against the sealing device seat.

Under these conditions, the unseating at 1065 may include unseating via application of an unseating pressure differential between the tubular conduit and the subterranean formation. The unseating pressure differential may be such that the pressure within the tubular conduit is less than the pressure within the subterranean formation, thereby providing a pressure force for the unseating. It is within the scope of the present disclosure that the primary seating portion may remain seated on the sealing device seat unless a magnitude of the unseating pressure differential is greater than a threshold unseating pressure differential. Examples of the threshold unseating pressure differential include unseating pressure differentials that are at least 2.5%, at least 5%, at least 7.5%, at least 10%, at least 15%, at most 30%, at most 25%, at most 20%, and/or at most 15% of the seating pressure differential.

It is within the scope of the present disclosure that hydrocarbon wells 10, wellbore tubulars 40, SSPs 100, sealing devices 142, sealing assemblies 920, and/or sealing devices 940, which are disclosed herein, may be utilized in any suitable manner, including those that are in addition to, or alternative to methods 1000. As an example, a hydrocarbon well may include a plurality of longitudinally spaced-apart SSPs, all of which may be in the open state. Under these conditions, one or more sealing devices 940 may be deployed into tubular conduit 42 to seal one or more SSPs 100. The horizontal wellbore length may extend beyond 5000' in axial length and may include several hundred SSP's. The entire length of the wellbore may be completed in over 50 "stages" of opening groups of perforations and stimulation of that group. Dozens of sealing devices may be deployed either in sub-stages, or near the end of the stimulation job for a particular stage. Thereby, the subsequent group of SSP's may be "opened" by explosive devices and stimulated in another stimulation treatment job. In general, the deployed sealing devices preferentially may seal SSPs 100 with greater fluid flow rates therethrough, and a stimulant fluid subsequently may be provided to the tubular conduit to stimulate one or more portions of the subterranean formation that are proximal to, or associated with, one or more SSPs 100 that were not sealed by the deployed sealing devices 940.

A benefit of the described sealing devices of this disclosure with regard to restimulating a formation is the ability to effectively seal on previously completed and produced SSP's that, in spite of being manufactured from an erosion resistant material, may still have suffered some erosion, leading to non-round apertures therein. After completion of the initially installed sets of SSP's along the entire length of the wellbore, the well may be put on production for a period of time or indefinitely. Production performance may be monitored during the producing period to observe for productivity performance along the wellbore length and changes in productivity along the wellbore length, for a period of time, such as weeks, months, or even several years. A couple of conclusions may be determined from the productivity monitoring and measurement. In one scenario, it may be determined from the production monitoring that some SSP's did not receive adequate stimulation treatment during the initial stimulation and need to be individually stimulated again, through the SSP. As the SSP's are manufactured from an erosion resistant material and the sealing devices are configured to seal on an eroded seat anyways, a subsequent stimulation treatment may be performed by providing sealing devices on perforations that do not require restimulation, while the remaining SSP's may be restimulated to receive proper effective stimulation.

In another scenario, it may be determined that additional perforations and stimulation treatments are needed in certain portions of the subterranean formation along the axial length of the wellbore that were not completed and stimulated via SSP's. In such circumstances, shaped-charge perforating guns may be deployed to perforate the wellbore tubular in a location that is intermediate existing SSP's (the term "intermediate" meaning merely between SSP's, not necessarily in the precise middle between SSP's) whereby an additional zone or portion of the formation may be completed and produced. In such instance, a plurality of sealing devices 940 may be deployed to seal all of the open SSPs 100. A perforation device or gun may be deployed within the tubular conduit to create one or more perforations therein. Thereafter, the plurality of sealing devices block fluid flow into the previously existing SSP's to direct stimulation fluid, hydraulic energy, and proppant slurry into the "new" perforations and subterranean formation for stimulation thereof. The secondary sealing portions (tentacles, etc.) of the adaptive sealing devices extending outwardly from the primary sealing portion thereof, may be released from an encasement or may be launched into the wellbore such that the tentacles may incur drag and dynamic fluid movement forces thereon due to the increased surface area provided by the secondary portions. Some of the tentacles may be drawn by fluid flow first toward a perforation tunnel and then into the tunnel with the high fluid velocity pulling the sealing device into sealing engagement on the perforation face in the wellbore. This may provide both enhanced "sealing action" reliability in a sealing device finding a perforation or SSP to seat on, and enhanced sealing functionality by the subject sealing devices, as compared to more conventional ball sealers which may otherwise flow on past a perforation tor SSP, potentially leaving an undesirable leak path or open SSP.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

INDUSTRIAL APPLICABILITY

The systems and methods disclosed herein are applicable to the oil and gas industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A method of stimulating a subterranean formation via a wellbore tubular conduit, the method comprising;

a) pressurizing the tubular conduit to a pressure of at least 30 megapascals with stimulant fluid;

wherein the wellbore tubular conduit extends within the subterranean formation and includes at least one selective stimulation port (SSP);

wherein each of the at least one SSP includes:

(i) an SSP body having a conduit-facing region and a formation-facing region;

(ii) an SSP conduit that is defined by the SSP body and extends between the conduit-facing region and the formation-facing region;

(iii) an isolation device extending within the SSP conduit and configured to selectively transition from a closed state, in which the isolation device restricts fluid flow through the SSP conduit, and an open state, in which the isolation device permits fluid flow through the SSP conduit;

(iv) a retention device coupling the isolation device to the SSP body to retain the isolation device in the closed state prior to receipt of a shockwave that has greater than a threshold shockwave intensity; and (v) a sealing device seat defined by the conduit-facing region of the SSP body;

during the pressurizing, retaining the isolation device in the closed state;

b) generating a shockwave within a wellbore fluid that extends within the tubular conduit;

wherein the generating includes generating within a region of the tubular conduit that is proximal the SSP such that a magnitude of the shockwave, as received by the SSP, is greater than a threshold shockwave intensity, responsive to receipt of the shockwave that has greater than the threshold shockwave intensity, transitioning the isolation device from the closed state to the open state to permit fluid communication, via the SSP conduit, between the tubular conduit and the subterranean formation;

c) responsive to the transitioning, flowing the stimulant fluid via the SSP conduit into a first portion of the subterranean formation for at least a threshold stimulation time to stimulate the portion of the subterranean formation;

d) subsequent to flowing the stimulant fluid, flowing a sealing device into contact with the sealing device seat;

wherein the sealing device includes;

(i) a primary sealing portion configured to seat upon the sealing device seat, at least partially restricting fluid flow through the SSP conduit with the primary sealing portion of the sealing device and (ii) at least one secondary sealing portion that extends from the primary sealing portion, at least partially restricting fluid flow through a leakage pathway between the primary sealing portion and the sealing device seat;

e) repeating steps a)-d) for another portion of the subterranean formation, using another SSP including another sealing device on another sealing device seat;

f) removing the sealing device and the another device from their respective sealing device seats;

g) producing hydrocarbons through the fluid conduit via the SSP and the another SSP;

h) thereafter sealing each of the SSP's with yet another sealing device;

i) perforating the tubular conduit intermediate the first portion of the subterranean formation and the another portion of the subterranean formation with a perforating gun to create an intermediate perforation in the tubular conduit; and j) flowing another stimulant fluid into the subterranean formation through the created intermediate perforation to stimulate a portion of the subterranean formation adjacent the intermediate perforation.

2. The method of claim 1, wherein, prior to the flowing the sealing device, the method further includes providing the sealing device to the tubular conduit, wherein the providing includes at least one of:

(i) providing from a surface region; and (ii) providing from a sealing device compartment.

3. The method of claim 2, wherein the providing the sealing device includes providing a sealing assembly, wherein the sealing assembly includes a shell defining an enclosed volume, wherein the sealing device is positioned within the enclosed volume, and further wherein the method includes applying a release stimulus to the shell to release the sealing device from the shell, wherein the applying the release stimulus includes at least one of:

(i) applying a shear force to the shell;

(ii) fluidly contacting the shell with an acidic solution;

(iii) fluidly contacting the shell with water;

(iv) fluidly contacting the shell with a hydrocarbon fluid;

(v) fluidly contacting the shell with the wellbore fluid;

(vi) fluidly contacting the shell with the stimulant fluid;

(vii) applying the shockwave to the shell;

(viii) applying a mechanical force to the shell; and (ix) applying a pressure force to the shell.

4. The method of claim 1, wherein the at least partially restricting fluid flow through the SSP conduit includes at least one of:

(i) seating the primary sealing portion on the sealing device seat;

(ii) mechanically contacting the primary sealing portion with the sealing device seat; and (iii) deforming the primary sealing portion via physical contact with the sealing device seat.

5. The method of claim 1, wherein the at least partially restricting fluid flow through the leakage pathway includes at least one of:

(i) flowing the secondary sealing portion into a gap between the primary sealing portion and the sealing device seat;

(ii) compressing the secondary sealing portion between the primary sealing portion and the sealing device seat; and (iii) mechanically contacting at least a first region of the secondary sealing portion with the sealing device seat and mechanically contacting at least a second region of the secondary sealing portion with the primary sealing portion.

6. The method of claim 1, wherein the generating includes detonating an explosive charge within the tubular conduit.

7. The method of claim 1, wherein the transitioning includes at least one of:

(i) shattering a frangible disk that defines at least a portion of the isolation device; and (ii) displacing an isolation disk, which defines at least a portion of the isolation device, from the SSP conduit.

8. The method of claim 1, wherein the SSP is a first SSP, wherein the wellbore tubular includes a plurality of spaced-apart SSPs, and further wherein the method includes repeating at least the pressurizing, the retaining, the generating, the transitioning, the flowing the stimulant fluid, the flowing the sealing device, the at least partially restricting fluid flow through the SSP conduit, and the at least partially restricting fluid flow through the leakage pathway to stimulate a portion of the subterranean formation that is proximal a second SSP of the plurality of spaced-apart SSPs.

9. The method of claim 8, further comprising:

flowing another of the sealing devices into contact with the intermediate perforation to at least partially restrict fluid flow through the intermediate perforation to provide another stage for pumping an additional volume of stimulation fluid.

10. The method of claim 1, wherein, prior to the pressurizing, the method further includes extending the wellbore tubular within a casing conduit defined by a casing string of a hydrocarbon well that extends within the subterranean formation, wherein the pressurizing includes pressurizing with a stimulant fluid that includes an abrasive material, wherein the flowing the stimulant fluid includes flowing such that the stimulant fluid impinges upon an inner casing surface of the casing string, and further wherein the method includes:

abrading the casing string, with the abrasive material of the stimulant fluid, to form a hole in the casing string; and responsive to formation of the hole, flowing the stimulant fluid into the subterranean formation, via the hole, to stimulate the subterranean formation.

11. The method of claim 1, wherein, the at least partially restricting fluid flow through the SSP conduit and the at least partially restricting fluid flow through the leakage pathway include seating the primary sealing portion on the sealing device seat via application of a seating pressure differential between the tubular conduit and the subterranean formation such that a pressure within the tubular conduit is greater than a pressure within the subterranean formation.

12. The method of claim 11, wherein, subsequent to the seating the primary sealing portion, the method further includes unseating the primary sealing portion via application of an unseating pressure differential between the tubular conduit and the subterranean formation such that the pressure within the tubular conduit is less than the pressure within the subterranean formation, wherein a magnitude of the unseating pressure differential is at least 5% and at most 20% of a magnitude of the seating pressure differential.

13. The method of claim 11, wherein the primary sealing portion resists being unseated from the sealing device seat when an unseating pressure differential between the tubular conduit and the subterranean formation is less than 5% of the seating pressure differential.

14. The method of claim 1, further comprising pressurizing the wellbore tubular conduit subsequent to step g) and prior to step h).

15. The method of claim 1, further wherein the primary portion of the sealing device and the secondary portion of the sealing device are fabricated from the same material.

16. The method of claim 1, wherein the wellbore tubular conduit further comprises:

an external surface and an internal surface;

a plurality of the selective stimulation ports (SSPs), wherein each of the at least one SSP of the plurality of SSPs includes:

(i) the SSP conduit extending between the internal surface of the tubular body and the external surface of the tubular body; and (ii) the sealing device seat shaped to form a fluid seal with a sealing device that selectively flows into engagement with the sealing device seat; and a plurality of sealing devices, wherein each of the plurality of sealing devices is associated with a corresponding sealing device seat of a corresponding SSP of the plurality of SSPs and includes:

(i) a primary sealing portion, which is seated on the corresponding sealing device seat and forms a primary seal with the corresponding sealing device seat to at least partially restrict fluid flow through the SSP conduit; and (ii) at least one secondary sealing portion, which extends from the primary sealing portion and forms a secondary seal between the primary sealing portion and the corresponding sealing device seat to at least partially restrict fluid flow through a leakage pathway between the primary sealing portion and the corresponding sealing device seat;

at least one perforation formed by a perforating gun intermediate two of the plurality of SSP's.

17. The wellbore tubular of claim 16 wherein the primary sealing portion is formed from at least one of:

(i) an acid-soluble material;

(ii) a water-soluble material;

(iii) a hydrocarbon-soluble material;

(iv) a nylon;

(v) a polyglycolic acid (PGA);

(vi) a polylactic acid (PLA); and (vii) a frangible material.

18. The wellbore tubular of claim 16, wherein the at least one secondary sealing portion is at least one of:

(i) elongate;

(ii) tentacular;

(iii) fibrous;

(iv) dendritic;

(v) branched; and (vi) tendrilous.

19. The wellbore tubular of claim 16, wherein the at least one secondary sealing portion includes a plurality of secondary sealing portions.

20. The wellbore tubular of claim 16, wherein the secondary sealing portion is formed from at least one of:

(i) an acid-soluble material;

(ii) a water-soluble material;

(iii) a hydrocarbon-soluble material;

(iv) a nylon;

(v) a polyglycolic acid (PGA);

(vi) a polylactic acid (PLA); and (vii) a frangible material.

21. The wellbore tubular of claim 16, wherein a surface area to volume ratio of the at least one secondary sealing portion is at least 4 times larger than a surface area to volume ratio of the primary sealing portion.

* * * * *